US008710768B2

(12) United States Patent
Rogers et al.

(10) Patent No.: US 8,710,768 B2
(45) Date of Patent: Apr. 29, 2014

(54) ALGORITHM FOR COLOR CORRECTED ANALOG DIMMING IN MULTI-COLOR LED SYSTEM

(75) Inventors: Jason Rogers, Herndon, VA (US); Rashmi K. Raj, Gainesville, VA (US)

(73) Assignee: ABL IP Holding LLC, Conyers, GA (US)

( * ) Notice: Subject to any disclaimer, the term of this patent is extended or adjusted under 35 U.S.C. 154(b) by 159 days.

(21) Appl. No.: 13/464,480

(22) Filed: May 4, 2012

(65) Prior Publication Data

US 2013/0293147 A1 Nov. 7, 2013

(51) Int. Cl.
*H05B 37/00* (2006.01)
*F21V 9/00* (2006.01)

(52) U.S. Cl.
USPC ..... 315/297; 315/294; 315/308; 362/231; 362/85; 345/690

(58) Field of Classification Search
USPC ..... 315/250, 291, 292, 294, 295, 297, 307, 315/308, 312, 316, 317, 318, 322; 362/84, 362/85, 230, 231, 235, 276; 345/63, 690
See application file for complete search history.

(56) References Cited

U.S. PATENT DOCUMENTS

| | | | | |
|---|---|---|---|---|
| 7,478,922 | B2 * | 1/2009 | Garbus, Jr. | 362/231 |
| 7,560,677 | B2 * | 7/2009 | Lyons et al. | 250/205 |
| 7,626,345 | B2 | 12/2009 | Young | |
| 8,264,168 | B2 * | 9/2012 | Feri et al. | 315/294 |
| 8,294,074 | B2 * | 10/2012 | Lyons et al. | 250/205 |
| 8,363,069 | B2 * | 1/2013 | Aldrich et al. | 345/690 |
| 2008/0103714 | A1 | 5/2008 | Aldrich et al. | |
| 2010/0102756 | A1 | 4/2010 | Shin | |
| 2010/0301777 | A1 | 12/2010 | Kraemer | |
| 2010/0308742 | A1 | 12/2010 | Melanson | |
| 2011/0181199 | A1 | 7/2011 | Lin | |
| 2012/0013255 | A1 | 1/2012 | Young | |
| 2012/0038287 | A1 | 2/2012 | Li | |

FOREIGN PATENT DOCUMENTS

| | | | |
|---|---|---|---|
| WO | 2009035493 | A1 | 3/2009 |
| WO | 2011024101 | A1 | 3/2011 |

OTHER PUBLICATIONS

Philippe Colantoni et al., "Color Space Transformations," 2004.
International Search Report and Written Opinion issued in International Application No. PCT/US2013/037961, dated Aug. 20, 2013.

* cited by examiner

*Primary Examiner* — Vibol Tan
(74) *Attorney, Agent, or Firm* — RatnerPrestia

(57) ABSTRACT

A lighting system having at least three light sources receives an input relating to color coordinates of a target point representing a desired color characteristic for a combined output from the light sources. The system defines first-pass endpoints corresponding to color characteristics of the light sources when operated at respective maximum intensities. The system determines first-pass amounts of respective maximum intensity contributions from the light sources to achieve light of the target point. When dimming the light to an intensity proportion, the system determines first-pass driver settings from the first-pass amounts and the intensity proportion. The system defines second-pass endpoints corresponding to color characteristics of the light sources when operated at the determined first-pass driver settings. The system determines, from the second-pass endpoints, second-pass amounts of respective reduced intensity contributions from the light sources; and the system determines second-pass driver settings for the second-pass amounts.

21 Claims, 20 Drawing Sheets

ALGORITHM FOR COLOR CORRECTED ANALOG DIMMING IN MULTI-COLOR LED SYSTEM

TECHNICAL FIELD

The present subject matter generally relates to techniques and equipment for color correction of a dimmed light produced by a system that combines light from multiple color sources. Disclosed examples provide color correction in a multi-color lighting system to produce a color corrected output light having a color characteristic corresponding to a target color point when a light of the target color point is dimmed to a proportion of a maximum intensity.

BACKGROUND

An increasing variety of lighting applications utilize electronic type emitters as light sources. Examples of such emitters include solid state light sources, such as light emitting diodes (LEDs) and organic light emitting diodes (OLEDs) as well as plasma type light emitters. For many lighting applications, it is desirable or even possibly required to effectively and efficiently dim the emitted light. Dimming of an electronic source, however, raises issues. Consider an LED type system by way of an example. An LED produces light output, when a voltage across two terminals thereof (e.g., anode and cathode) exceeds the LED's forward voltage so that forward current can flow through the LED. The intensity of light output from the LED is primarily governed by the amount of forward current flowing through the LED. Therefore, in order to dim a light emitted from the LED, the forward current flowing through the LED needs to be manipulated.

There are two commonly used methods for dimming lights from LEDs. One is Pulse Width Modulation (PWM) Dimming, and the other is Analog Dimming. Both methods result in changing the average current through the LEDs and hence provide a visual appearance of changing intensities of light output from the LEDs.

In its most common form, PWM Dimming turns an LED ON and OFF for variable amounts of time but at a frequency higher than the fusion frequency of a human's visual perception. This turning ON/OFF is normally performed at a fixed frequency. Because of the frequency, the light appears to be continuously ON. The pulse width of a duty cycle, i.e., how long the LED is ON or OFF, is varied to turn the LED ON and OFF for desired amounts of time. That is, a smaller duty cycle will result in smaller 'ON TIME' and hence lesser light per cycle. Thus, by changing the duty cycle and thereby varying the average current through the LED, PWM Dimming manipulates the average light output. In this method, however, the peak current is not varied, and the appearance of less or more light is achieved only by changing the duty cycle.

On the other hand, in Analog Dimming, the peak current flowing through the LED is directly manipulated to vary output light intensity. That is, current continuously flows through the LED, and dimming is achieved by changing the peak current (and hence the average) current flowing through the LED. Thus, when the current is lower, the light output will be lower.

Among these two dimming methods, PWM Dimming suffers from some drawbacks. PWM Dimming, or any of its varieties, requires the LEDs to frequently turn ON and OFF, which may lead to the visual perception of 'flicker' if the frequency is too low. Flicker effects increase at lower duty cycles. Such flicker can be very annoying to an observer, since such flicker indicates that the observer's eye detects LEDs turning ON and OFF. At low frequencies or even at high frequencies (several kilohertz) with low duty cycles, such flicker may be visible. Perception of flickers differs among people, and some people can see flickers at frequencies higher than other people may see. Flicker becomes even more of an issue when there is a relative motion between the observer and a source of light (for example, the LED). This flicker problem is more pronounced in multi-color LED systems in which it is possible that different colors from different LEDs are pulsing at different rates and phases. Hence, flicker in such multi-color LED systems may produce a very undesirable visual appearance. There also are many studies in progress, including Wilkins et al. "LED Lighting Flicker and Potential Health Concerns: IEEE Standard PAR1789 Update," that suggest that flicker in LEDs can be a health hazard in humans.

Moreover, PWM Dimming is less efficient than Analog Dimming. FIG. 1 illustrates an example of an LED's relative luminous flux characteristic, i.e., a relationship between forward current and relative luminous flux. Consider an example of a pulse width modulating at 100 Hz at a maximum current of 1000 mA with a Green LED having the characteristic of FIG. 1. The graph of FIG. 1 shows a relative luminous flux with respect to the light output at 350 mA. Let X denote the light output at 350 mA. If the Green LED at 1000 mA was pulse width modulated at 100% duty cycle, which means ON for 100% time, then the average light output would be 2.1 times X lumens. In other words, to achieve X lumens, the Green LED would have to be pulsed at 47.6% duty cycle (1/2.1). In contrast, if the LED was dimmed using Analog Dimming, it would be continuously driven at 350 mA to get X lumens. In order to compare efficiency between the two dimming methods, referring to the graph in FIG. 2, power consumptions in the two dimming methods can be calculated as follows. In PWM Dimming, the forward voltage at 1000 mA is approximately 4.4 Volts. Thus, at 47.6% duty cycle, which is the duty cycle to achieve X lumens, the average power consumption is 2.094 W=(4.4V*1000 mA*0.476). On the other hand, in Analog Dimming, to achieve X lumens, the average power consumption is 1.225 W=(3.5V*350 mA). Therefore, in order to achieve the same average light output from the LED, PWM Dimming is less efficient than Analog Dimming.

For the above-noted reasons, there is an industry-wide consensus that Analog Dimming may be superior to PWM Dimming. However, Analog Dimming has a drawback of undesirable color variation. In a given LED, if the peak current is varied, the current density (or J) also varies. More particularly, in a Gallium Nitride (GaN) based LED system (for example, Blue and Green type LEDs), a varying current density may lead to not only a varying intensity output but also a varying chromaticity output. In other words, in GaN based materials, Analog Dimming may lead to both intensity and chromaticity variations. While the intensity variation is a desirable effect of dimming, the associated chromaticity variation may not be a desirable one. For example, referring to the graph in FIG. 3, with Analog Dimming in Green LEDs, the chromaticity ((x, y)-coordinates of five connected dots in FIG. 3) shifts due to different forward currents of the LEDs used to produce light (at the five connected dots in FIG. 3). Moreover, as shown in FIG. 4, this shift in chromaticity results in changing dominant wavelength.

Hence a need exists for techniques and equipment for color correction of a light emitted from a lighting system to correct for a color change with Analog Dimming of the light.

Additionally, almost all LEDs show a change in light output as the LEDs heat up or cool down. This change may be characterized in terms of the LEDs' color (chromaticity) or lumen output. Heat based change in LED output is more pronounced in AlNGaP based materials systems compared to GaN based materials. Recently developed closed loop color correction algorithms employ a color sensor in a feedback system. With the use of the color sensor, the changes in lumen output could be rapidly corrected. However, the color sensor does not detect and correct the changes in chromaticity as the LEDs heat up.

Furthermore, almost all LEDs show degradations in light output over time during the LEDs' lifetime. FIG. 5 illustrates an example of an LED's lifetime degradation characteristic (i.e., hours used vs. light output). More particularly, FIG. 5 shows that light output of the LED has degraded by 14 percent after ten thousand hours. There are various well-known methods for correcting for changes in LED output due to such lifetime degradations. For example, a recently developed method uses a color sensor for correcting for lifetime degradation.

Hence, when Analog Dimming current density correction is applied, there is still room for further improvement in correcting for changes in color or lumen output of LEDs, either due to temperature changes of the lighting system or due to the LEDs' lifetime degradation.

SUMMARY

The teachings herein alleviate one or more of the above noted problems and provide improvements in color corrected Analog Dimming used in a lighting system, for example, in a system that combines light from multiple color sources to produce light of a desired color characteristic. Both methods and systems are discussed.

For example, a lighting system may include three light sources each for emitting light of a different one of three colors. Each light source includes one or more light emitters. The lighting system may include an input and a controller responsive to information received via the input. The controller is coupled to control the three light sources to produce a color corrected combined output light, having a desired color characteristic corresponding to a target color point dimmed to a proportion of a maximum target intensity. The lighting system receives an input relating to color coordinates of the target point defined in a color space, and performs first and second passes through a compensation process, as will be described in the following paragraphs, first to determine initial driver settings and then to determine color corrected driver settings to achieve the desired color characteristic but at the dimmed output intensity.

In the first pass, a first volume is defined in a first color space to have boundaries with endpoints corresponding to color characteristics of the light sources when operated at or near respective maximum intensities. The lighting system determines first-pass light amounts of respective maximum intensity light contributions from the light sources to achieve light at the target point. The lighting system then determines first-pass driver settings, i.e., initial driver settings, for the light sources based on the determined first-pass light amounts. For example, when the light is to be dimmed to a proportion of the maximum target intensity, the lighting system adjusts the first-pass driver settings in accordance with the determined first-pass light amounts and the proportion of the maximum target intensity.

In the second pass, a second volume is defined in the first color space to have boundaries with endpoints corresponding to reduced intensity color characteristics of the light sources when operated at the adjusted first-pass driver settings. The lighting system determines, from the second volume, second-pass light amounts of respective reduced intensity light contributions from the light sources to achieve light at the target point. The lighting system then determines second-pass driver settings, i.e., color corrected driver settings, for the light sources based on the determined second-pass light amounts.

By applying the determined second-pass driver settings to drive the light sources, the lighting system can produce a color corrected output light having a desired color characteristic corresponding to the target point dimmed to the proportion of the maximum target intensity.

In other examples, a method is provided for controlling a multi-color lighting system to produce a color corrected output light having a desired color characteristic corresponding to a target color point dimmed to a proportion of a maximum target intensity. The lighting system may include three light sources each including one or more light emitters, and each light source is configured to produce light of a different one of three colors. An input relating to color coordinates of the target point defined in a first color space is received. A first volume is defined in the first color space to have boundaries with endpoints corresponding to color characteristics of the light sources when operated at or near respective maximum intensities. First-pass light amounts of respective maximum intensity light contributions are determined from the light sources to achieve light at the target point. First-pass driver settings, i.e., initial driver settings, for the light sources are then determined based on the determined first-pass light amounts. When the light is to be dimmed to a proportion of the maximum target intensity, the first-pass driver settings are adjusted in accordance with the determined first-pass light amounts and the proportion of the maximum target intensity. Further, a second volume is defined in the first color space to have boundaries with endpoints corresponding to reduced intensity color characteristics of the light sources when operated at the adjusted first-pass driver settings. From the second volume, second-pass light amounts of respective reduced intensity light contributions are determined from the light sources to achieve light at the target point. Second-pass driver settings, i.e., color corrected driver settings, for the light sources are then determined based on the determined second-pass light amounts. The determined second-pass driver settings are applied to drive the light sources, thereby producing a color corrected output light having a color characteristic corresponding to the target point dimmed to the proportion of the maximum target intensity.

A variety of examples of extensions to the color correction methods are also discussed below and illustrated in the drawings. For example, a method may include a step of correcting for output changes of light emitters due to temperature changes. More particularly, data on operation of the light emitters at a first temperature is used to determine the first set of both the adjusted first-pass driver settings and the second-pass driver settings for the lighting system. Then, a second set of both adjusted first-pass driver settings and second-pass driver settings are determined for the lighting system using data on operation of the light emitters at a second temperature. Further, an interpolation is applied to at least the determined second-pass driver settings of the second set according to a third temperature that is different from the first and second temperatures, thereby obtaining an estimated set of second-pass driver settings for the lighting system at the third temperature.

Another example of such an extension may include correcting for an output change due to a lifetime degradation of light emitters during a particular period. More particularly, the determined first-pass light amounts used in the adjusting step of the color correction method are increased by an amount to compensate for the lifetime degradation during the particular period.

In other examples, the first-pass driver settings may be adjusted by obtaining intersection points located in the first volume. At each of the intersection points, a boundary line connecting a first one of the endpoints corresponding to the maximum intensity color characteristics of the light sources and a second one of the endpoints, intersects a line connecting the target point and a third one of the endpoints. The obtained intersection points and the first, second and third endpoints, are then converted into corresponding points defined in a second color space. Further, respective scaling factors of the converted second and third endpoints are calculated such that each of the converted intersection points is obtained by adding, to the converted first endpoint, one of the converted second endpoint multiplied by the respective first-pass scaling factor thereof and the converted third endpoint multiplied by the respective first-pass scaling factor thereof. The converted first endpoint is multiplied by the proportion of the maximum target intensity, thereby adjusting a first one of the first-pass driver settings. Each of the converted second and third endpoints by the respective first-pass scaling factor thereof and by the proportion of the maximum target intensity, thereby adjusting second and third ones of the first-pass driver settings. The second-pass driver settings may be adjusted in a similar manner, but without multiplying converted endpoints corresponding to the reduced target intensity by the proportion of the maximum target intensity.

Additional objects, advantages and novel features of the examples will be set forth in part in the description which follows, and in part will become apparent to those skilled in the art upon examination of the following and the accompanying drawings or may be learned by production or operation of the examples. The objects and advantages of the present subject matter may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings.

The various examples disclosed in this section relate to systems and methods for controlling a multi-color lighting system, which may use Analog Dimming, to produce a color corrected output light when a light emitted from the lighting system is dimmed to a proportion of a maximum intensity. The system uses sources of different colors of light. Each source includes one or more light emitters. Various types of emitters may be used to construct sources of respective colors of light. For example, the multi-color lighting system may use solid state light sources, such as light emitting diodes (LEDs) and organic light emitting diodes (OLEDs). Alternatively, one or more of the sources may use plasma type emitters. A variety of examples of such arrangements as well as techniques for making and operating such mechanisms, etc., that so produce a color corrected output light, are discussed below.

Figure 1:
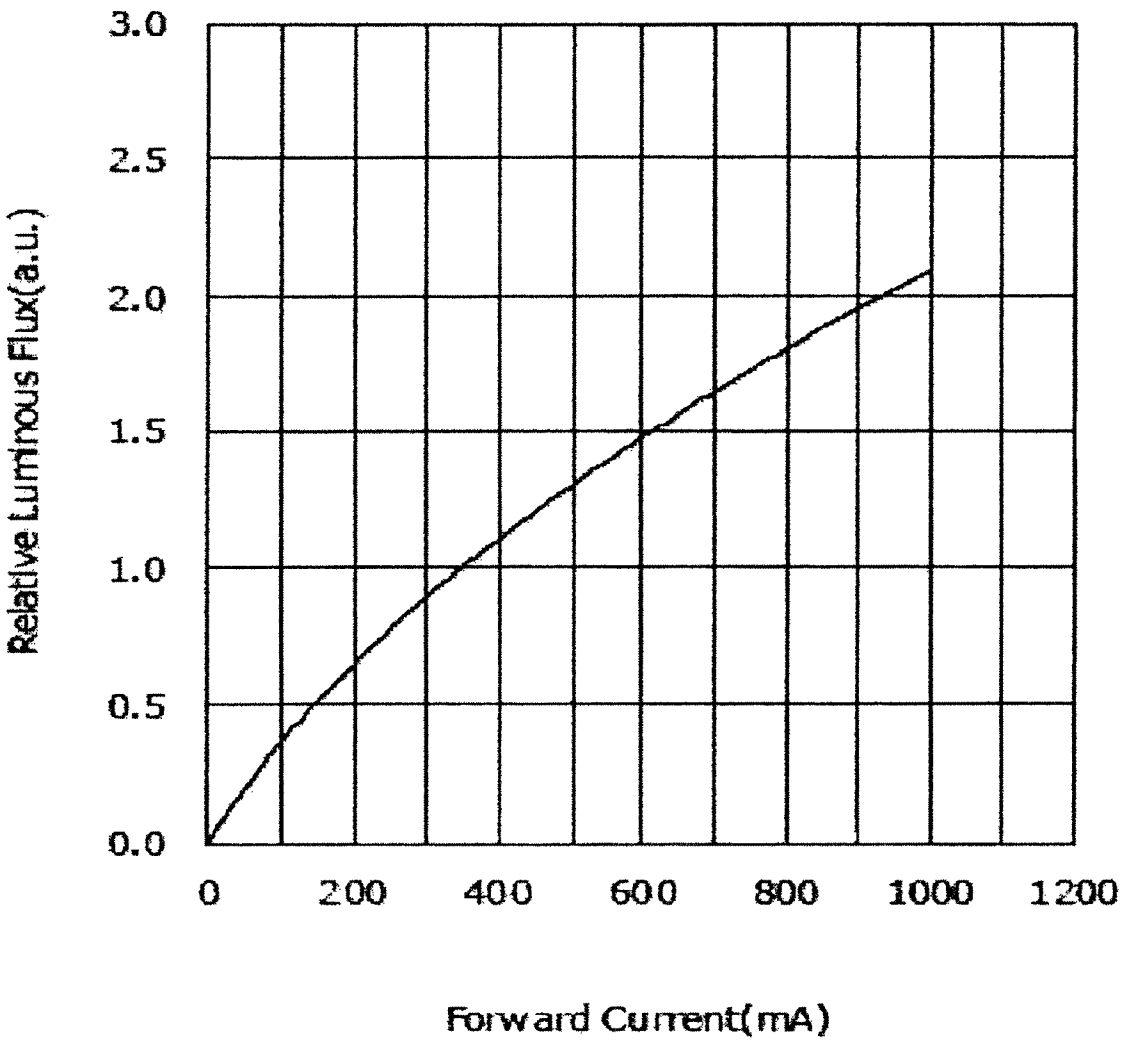
FIG. 1 illustrates an example of an LED's luminous flux characteristic (i.e., forward current vs. relative luminous flux) .
Figure 2:
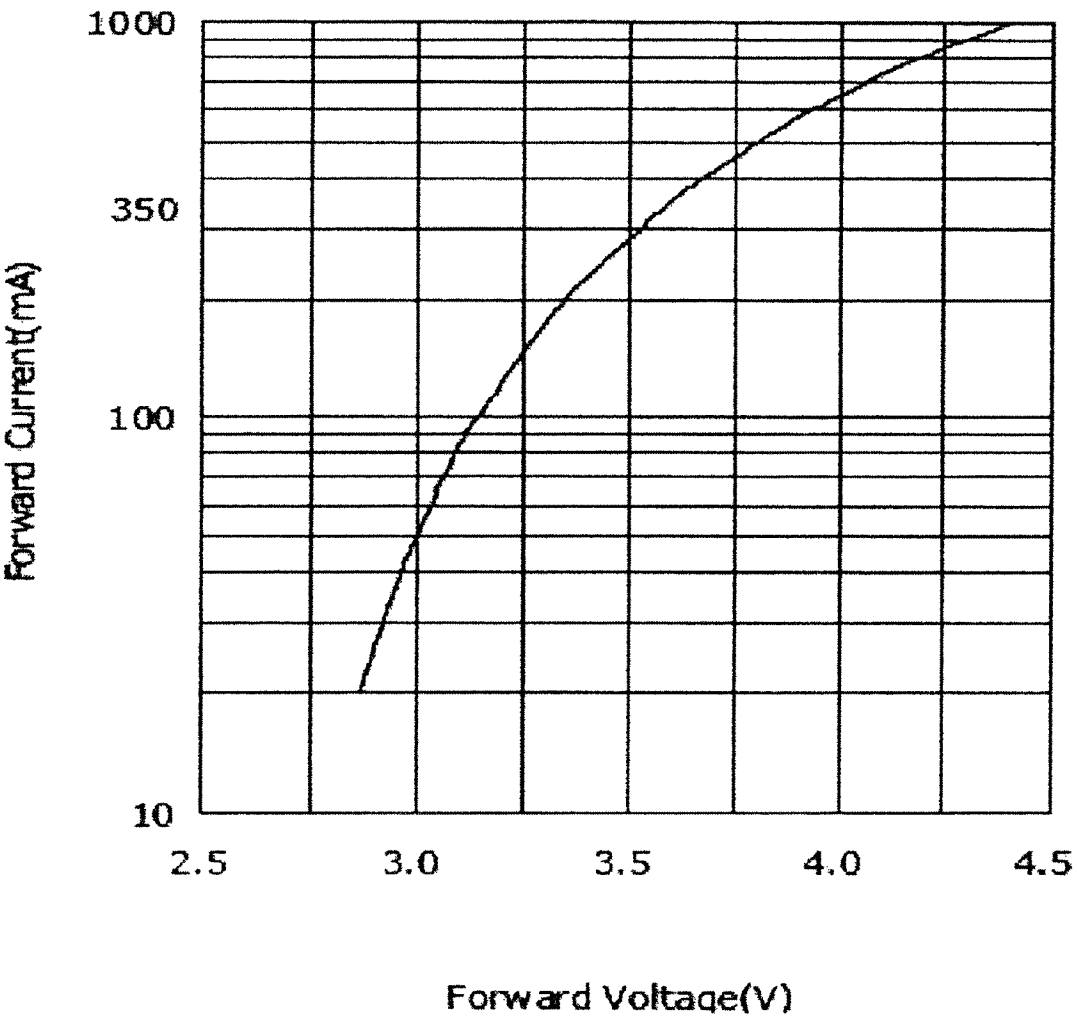
FIG. 2 illustrates an example of an LED's power consumption characteristic forward voltage vs. forward current).
Figure 3:
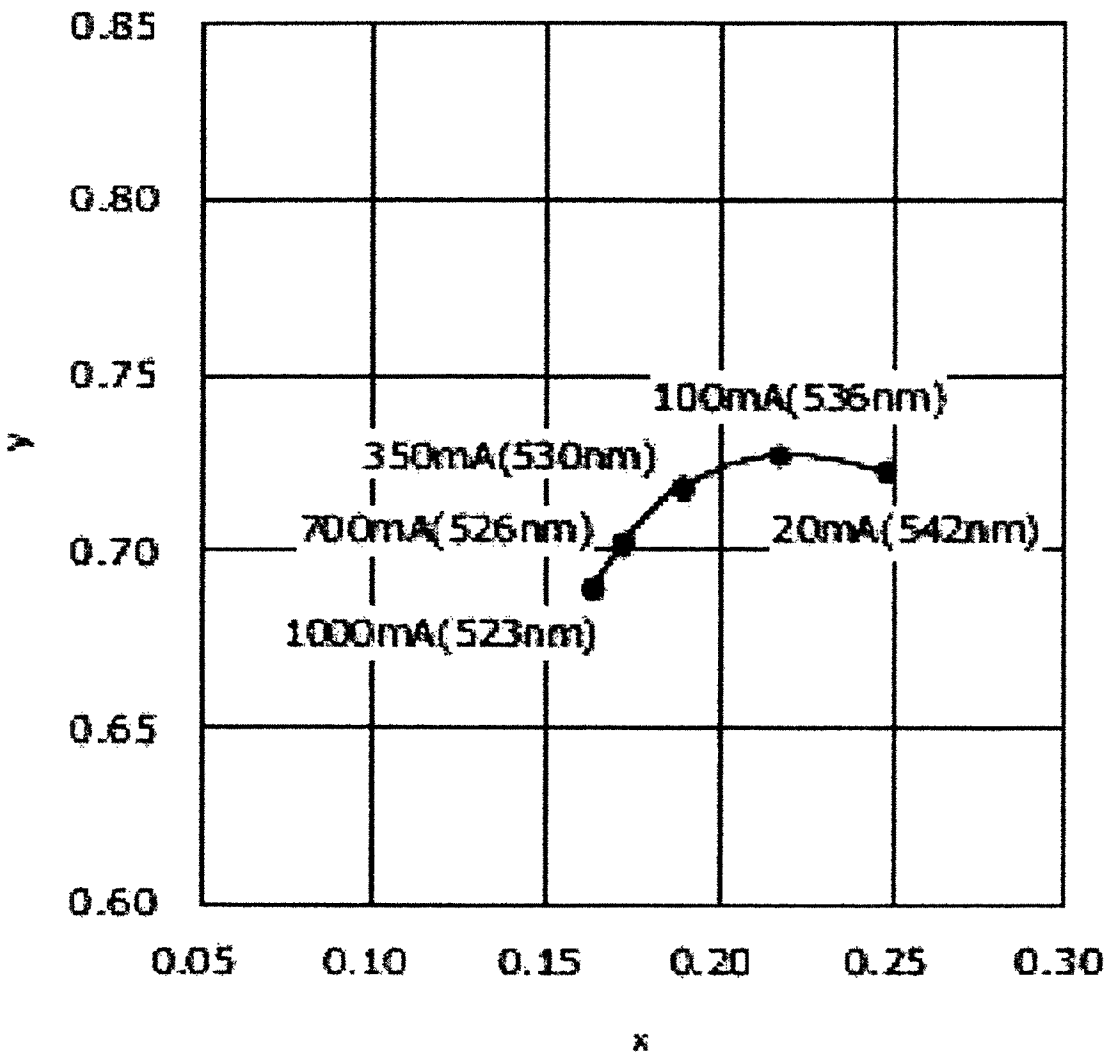
FIG. 3 illustrates an example of an LED's characteristic of chromaticity changes with Analog Dimming (i.e., due to forward current changes).
Figure 4:
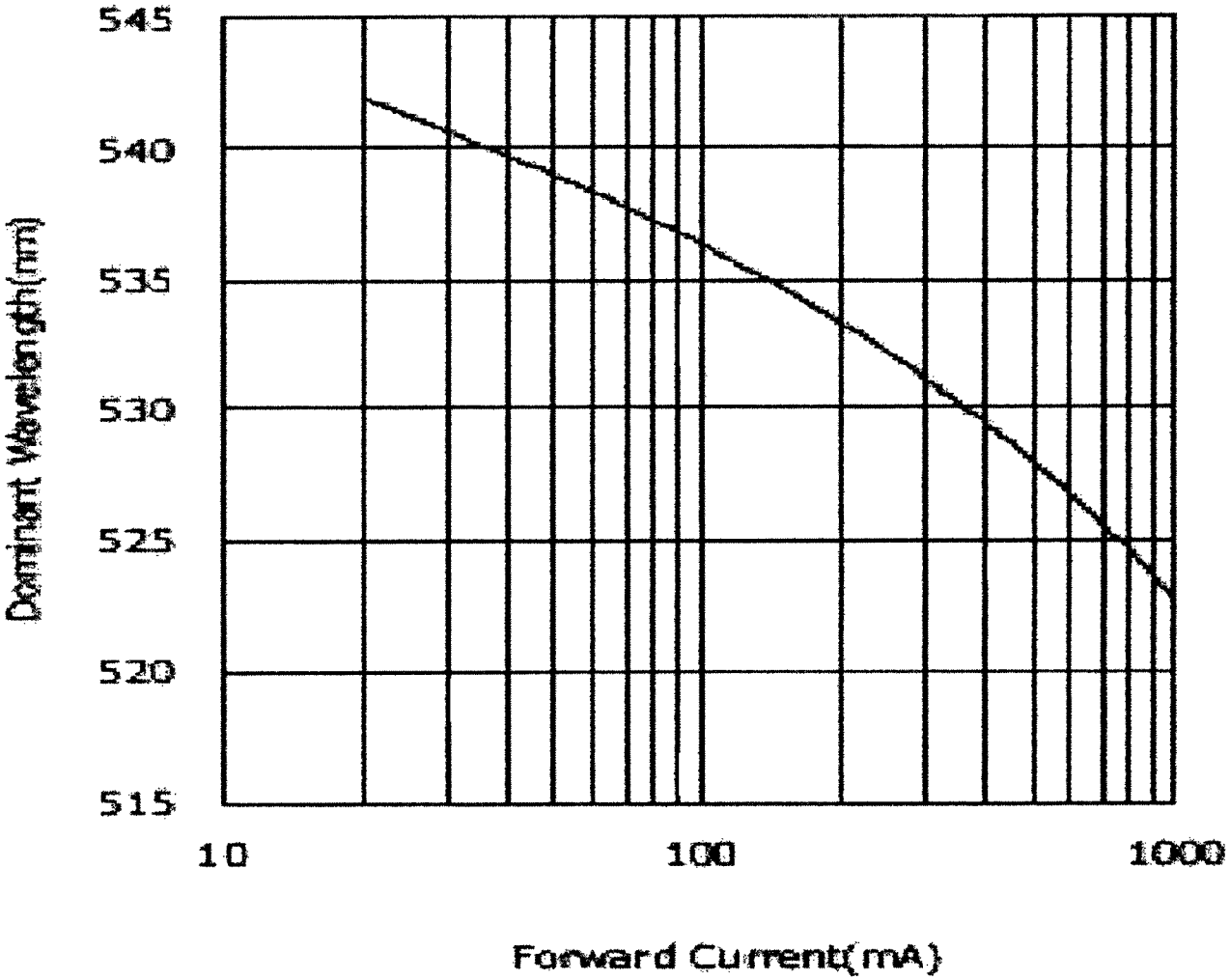
FIG. 4 illustrates an example of an LED's dominant wavelength characteristic (i.e., forward current vs. dominant wavelength).
Figure 5:
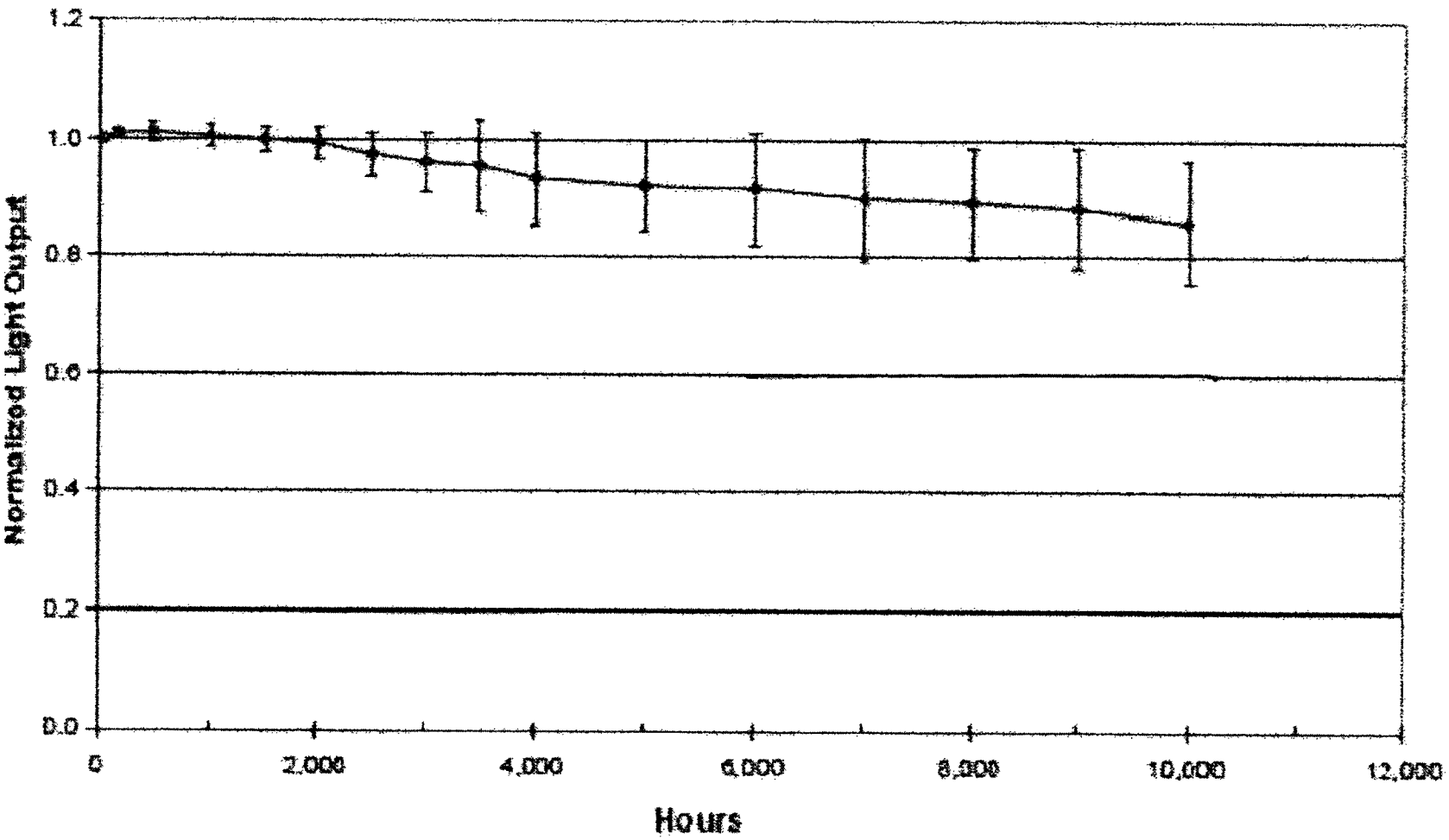
FIG. 5 illustrates an example of an LED's lifetime degradation characteristic (i.e., hours used vs. light output).
Figure 6:
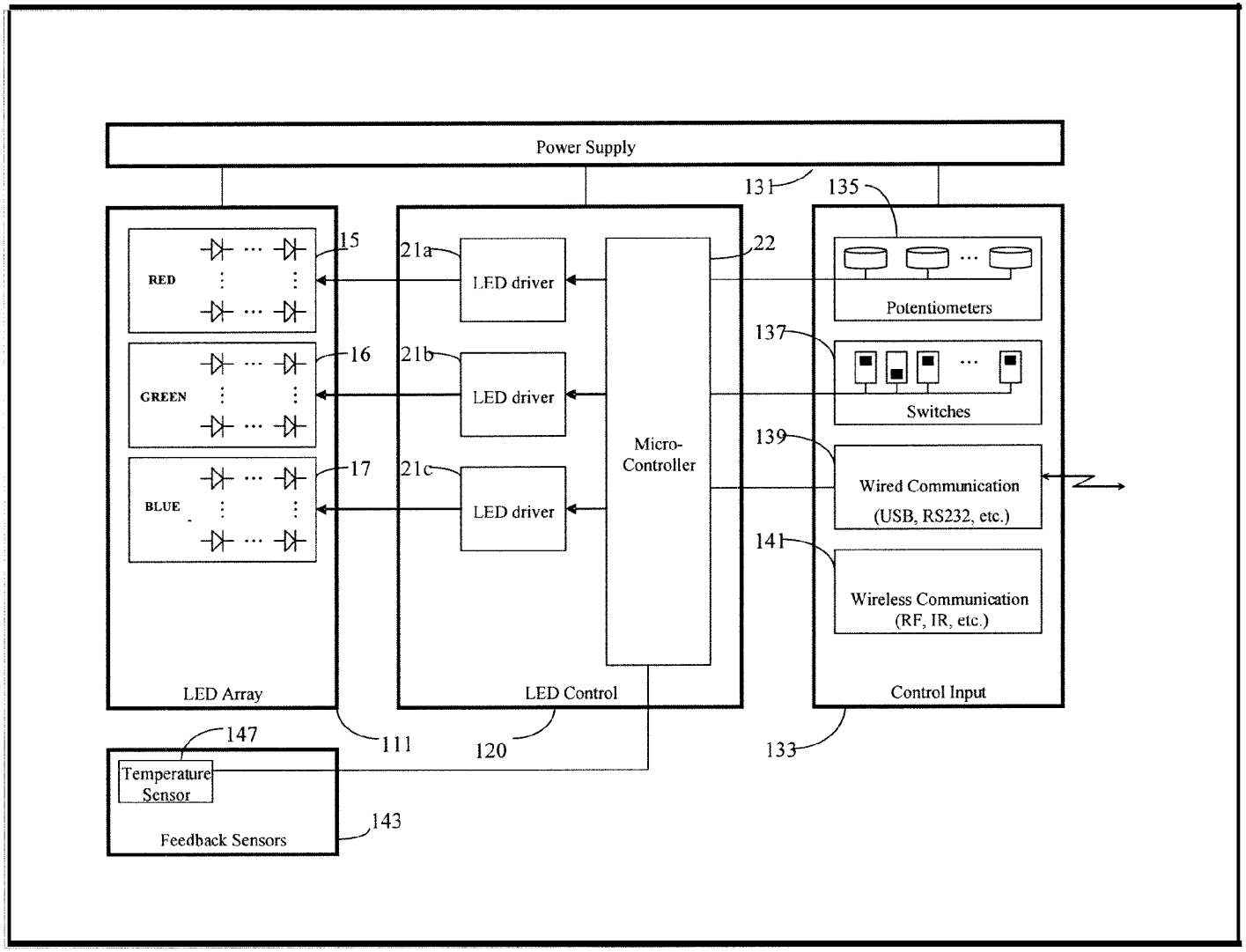
FIG. 6 is a functional block diagram of the electrical components of an example of a light emitting system using programmable digital control logic, where three channels drive three color light sources, i.e., Red LEDs, Green LEDs, and Blue LEDs, respectively.

Reference now is made in detail to the examples illustrated in the accompanying drawings and discussed below. FIG. 6 is a block diagram of an exemplary electrical system for light sources and associated control circuit, providing digital programmable control to produce a color corrected output light. In this circuit example, the light sources may take the form of a group of emitter devices within an LED array 111. The array 111 may include at least one Red LED 15 as a source of red light, at least one Green LED 16 as a source of green light, and at least one Blue LED 17 as a source of blue light, although other color LEDs may be used in place of or in addition to those shown (as in FIGS. 7-9). Other light emitter devices may be used as the emitters of the respective color light sources. Examples of the other electronic emitter devices include plasma devices and other solid state devices such as organic LEDs (OLEDs). For discussion and illustration purposes, examples that use one or more LEDs will be referred to as the emitter devices of each respective color light source.

The electrical components shown in FIG. 6 also include an LED control system 120. The system 120 includes driver circuits 21*a*, 21*b* and 21*c* for the various LEDs and a microcontroller 22. The driver circuits 21*a* to 21*c* supply electrical current to respective LEDs 15, 16 and 17 to cause the LEDs to emit light. In the example shown in FIG. 6, the three driver circuits 21*a* to 21*c* drive three color light sources, i.e., the Red LEDs 15, the Green LEDs 16 and the Blue LEDs 17, respectively. The intensity of the emitted light of a given LED is proportional to the level of current supplied by the respective driver circuit, so that the emitted light can be dimmed to a desired proportion of a maximum intensity. Further, the electrical system may also include one or more digital to analog converters (DACs) (not separately shown). In this regard, the microcontroller 22 may control the DACs, which in turn provide signals to the respective drivers 21*a* to 21*c*.

The analog current output level of each of the driver circuits 21*a* to 21*c* may be controlled by a higher level logic of the system. In this digital control example, that logic is implemented by the programmable microcontroller 22, although the logic could take other forms, such as discrete logic components, an application specific integrated circuit (ASIC), etc.

As shown in FIG. 6, the LED driver circuits 21*a* to 21*c* and the microcontroller 22 receive power from a power supply 131, which is connected to an appropriate power source (not separately shown). For most task-lighting applications, for example, the power source will be an AC line current source, however, some applications may utilize DC power from a battery or the like. The power supply 131 converts the voltage and current from the source to the levels needed by the driver circuits 21*a* to 21*c* and the microcontroller 22.

A programmable microcontroller may include or have coupled thereto random-access memory (RAM) for storing data and read-only memory (ROM) and/or electrically erasable read only memory (EEROM) for storing control programming and any pre-defined operational parameters, such as pre-established light 'recipes.' The microcontroller 22 itself includes registers and other components for implementing a central processing unit (CPU) and possibly an associated arithmetic logic unit. The CPU implements the program to process data in the desired manner and thereby generates desired control outputs.

Referring to FIG. 6, the microcontroller 22 is programmed to control the LED driver circuits 21*a* to 21*c* to set the individual output intensities of the LEDs to desired levels, so that the combined light emitted from the LEDs has a desired spectral characteristic and a desired overall intensity. The microcontroller 22 may be programmed to essentially establish and maintain or preset a desired 'recipe' or mixture of the available wavelengths provided by the LEDs. More particularly, the microcontroller 22 receives control inputs specifying the particular 'recipe' or mixture, as will be described below. The input information will include or can be translated to color coordinates of a target point, for a desired color characteristic for the combined output light from the system. The input information may also indicate an overall intensity or dimming level. The microcontroller also may be responsive to a feedback signal from a temperature sensor 147, for example, in or near the LEDs of the array 111.

As shown in FIG. 6, the electrical system may also include one or more control inputs 133 for inputting information instructing the microcontroller 22 as to the desired operational settings. A number of different types of inputs may be used and several alternatives are illustrated for convenience. A given installation may include a selected one or more of the illustrated control input mechanisms.

As one example, user inputs may take the form of a number of potentiometers 135. The number would typically correspond to the number of different light colors provided by the particular LED array 111, e.g., red, green and blue in this first example. The potentiometers 135 may connect through one or more analog to digital conversion interfaces provided by the microcontroller 22 (or in associated circuitry). To set the desired parameters for the integrated light output, the user may adjust the potentiometers 135 to set the intensity for each color which correlates to color coordinate. The microcontroller 22 senses the input settings and controls the LED driver circuits accordingly, to set appropriate actual intensity levels for the LEDs providing the light of the various colors. An additional potentiometer may provide an overall intensity or dimming input.

Another user input implementation might utilize one or more dip switches 137. For example, there might be a series of such switches to input a code corresponding to one of a number of recipes. The memory used by the microcontroller 22 would store the necessary color coordinate information for each recipe. Based on the input code, the microcontroller 22 retrieves the appropriate recipe from memory. Then, the microcontroller 22 controls the LED driver circuits 21*a* to 21*c* accordingly, to set appropriate intensity levels for the LEDs 15 to 17 providing the light of the various colors. A similar set of switches could be used as a dimmer setting.

As an alternative or in addition to the user input in the form of potentiometers 135 or dip switches 137, the microcontroller 22 may be responsive to control data supplied from a separate source or a remote source. For that purpose, some versions of the system will include one or more communication interfaces. One example of a general class of such interfaces is a wired interface 139. One type of wired interface typically enables communications to and/or from a personal computer or the like, typically within the premises in which a lighting system operates. Examples of such local wired interfaces include USB, RS-232, and wire-type local area network (LAN) interfaces. Other wired interfaces, such as appropriate modems, might enable cable or telephone line communications with a remote computer, typically outside the premises.

Other examples of data interfaces provide wireless communications, as represented by the interface 141. Wireless interfaces, for example, use radio frequency (RF) or infrared (IR) links. The wireless communications may be local on-premises communications, analogous to a wireless local area network (WLAN). Alternatively, the wireless communications may enable communication with a remote device outside the premises, using wireless links to a wide area network. Via such communications, a user can operate a compatible remote device to input information relating to a desired color characteristic (e.g., corresponding to coordinates for a target point in a color space). The user may also input information effectively specifying an overall output level, for dimming or the like.

The electrical components may also include one or more feedback sensors 143, to provide system performance measurements as feedback signals to the control logic, implemented in this example by the microcontroller 22. A variety of different sensors may be used, alone or in combination, for different applications. In the illustrated example, the set 143 of feedback sensors includes a temperature sensor 147. Although not shown, other sensors, such as an overall intensity sensor may be used. The sensors are positioned in or around the system to measure the appropriate physical condition, e.g. temperature, color, intensity, etc.

The temperature sensor 147 may be a simple thermo-electric transducer with an associated analog to digital converter, or a variety of other temperature detectors may be used. The temperature sensor is positioned on or inside of the lighting system, typically at a point that is near the LEDs or other sources that produce most of the system heat. The temperature sensor 147 provides a signal representing the measured temperature to the microcontroller 22. The system logic, here implemented by the microcontroller 22, can adjust intensity of one or more of the LEDs in response to the sensed temperature, e.g. to reduce intensity of the source outputs to compensate for temperature increases. The program of the microcontroller 22, however, would typically manipulate the intensities of the various LEDs so as to maintain the desired color balance between the various wavelengths of light used in the system, even though it may vary the overall intensity with temperature, or alternatively, drive the LEDs harder to maintain the intensity.

The above discussion of FIG. 6 is related to programmed digital implementations of the control logic, although the control also may be implemented using analog circuitry. FIG. 6 also depicts an example using red (R), green (G) and blue (B) LEDs. The color correction procedures under consideration here, however, are applicable in other control arrangements and/or in systems utilizing different colors of LEDs in three or more control channels.

Figure 7:
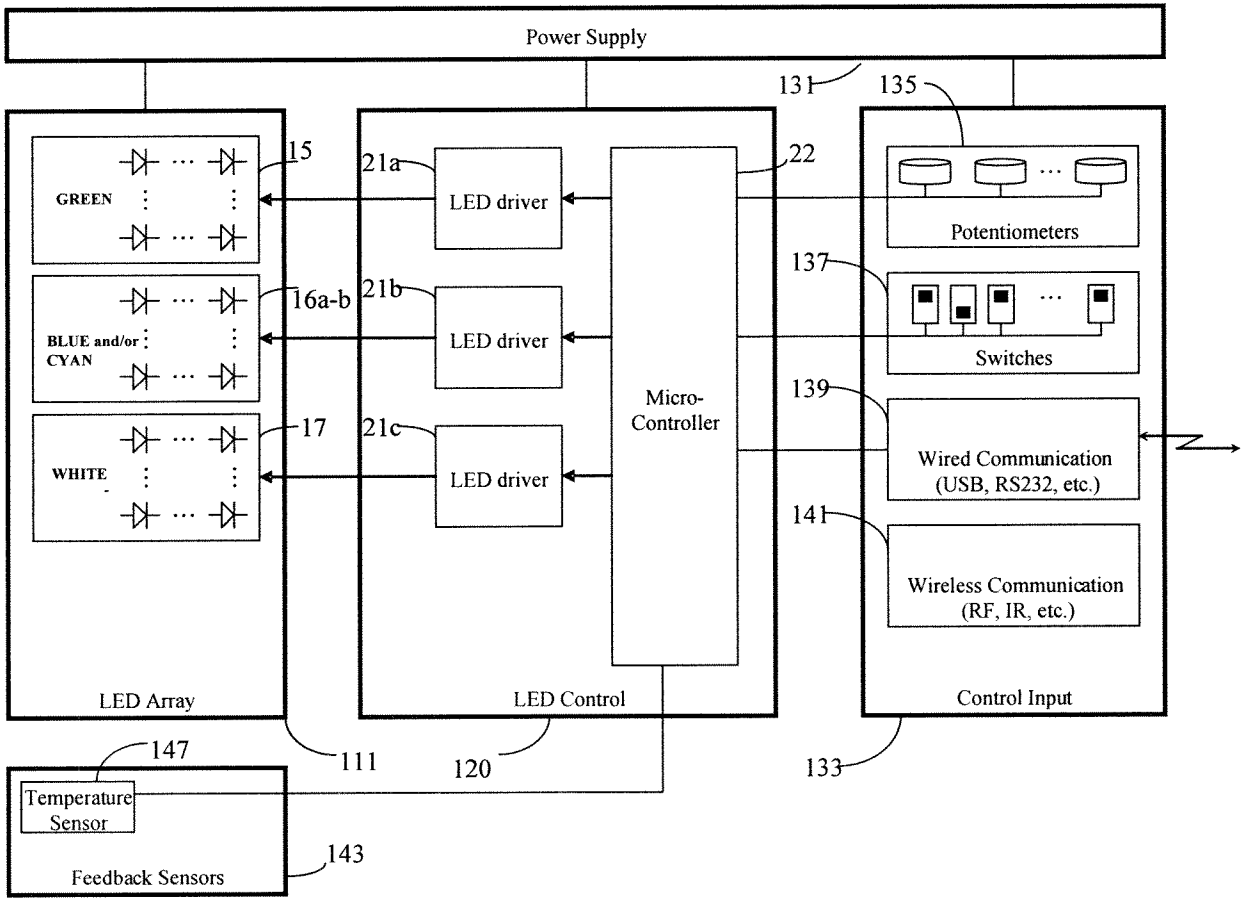
FIG. 7 is a functional block diagram of the electrical components of another example of a light emitting system using programmable digital control logic, where three channels drive three color light sources, i.e., Green LEDs, a combination of Blue and/or Cyan LEDs, and White LEDs, respectively.

FIG. 7 is a block diagram of another exemplary circuitry for light sources and associated control circuit, providing digital programmable control. This circuit example has a configuration similar to the configuration of the circuit example of FIG. 6, and where appropriate, similar elements are identified by the same reference numerals. Thus, the description of the same components as those of FIG. 6 will be omitted. The array 111 includes at least one Green LED 15, at least one White LED 17, and at least one Blue LED and/or at least one Cyan LED in the second control channel (i.e., 16*a*-16*b*). The three driver circuits 21*a*, 21*b* and 21*c* drive three color light sources, i.e., the Green LEDs 15, the Blue/Cyan LEDs 16*a*-16*b* and the White LEDs 17, respectively.

Figure 8:
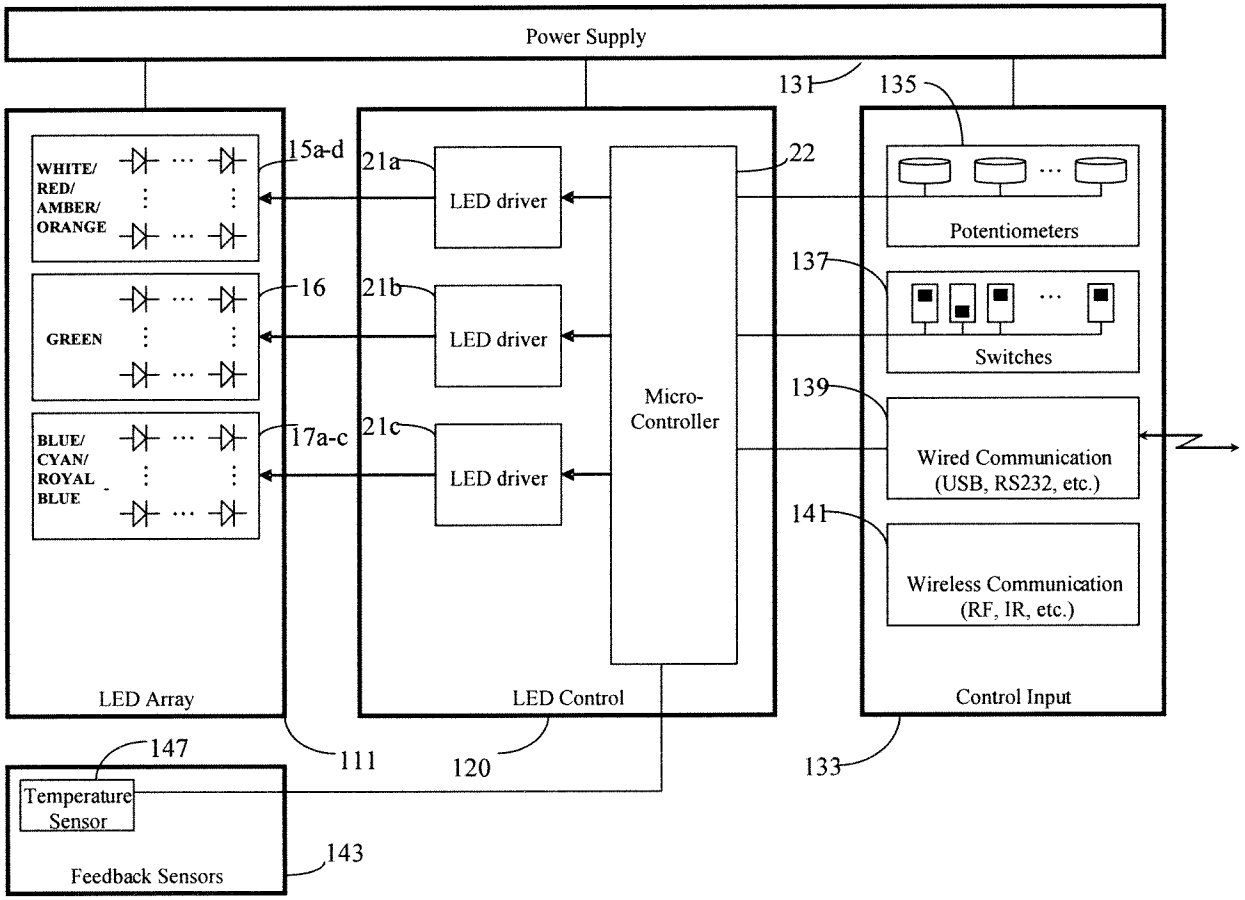
FIG. 8 is a functional block diagram of the electrical components of still another example of a light emitting system using programmable digital control logic, where three channels drive three color light sources, i.e., a combination of White, Red, Amber and Orange LEDs, Green LEDs, and a combination of Blue, Cyan and Royal Blue LEDs, respectively.

FIG. 8 is a block diagram of still another exemplary circuitry for light sources and associated control circuit, providing digital programmable control. This circuit example has a configuration similar to the configuration of the circuit example of FIG. 6, and where appropriate, similar elements are identified by the same reference numerals. Thus, the description of the same components as those of FIG. 6 will be omitted. The array 111 includes at least one Green LED 16, at least one White LED in series with at least one Red and/or Amber and/or Orange LED (i.e., 15*a*-15*c*), and at least one Blue LED in series with at least one Cyan and/or Royal Blue LED (i.e., 17*a*-17*c*). The three driver circuits 21*a*, 21*b* and 21*c* drive three color light sources, i.e., the Red/Amber/Orange LEDs 15*a*-15*c*, the Green LEDs 16 and the Blue/Cyan/Royal Blue LEDs 17*a*-17*b*, respectively.

Figure 9:
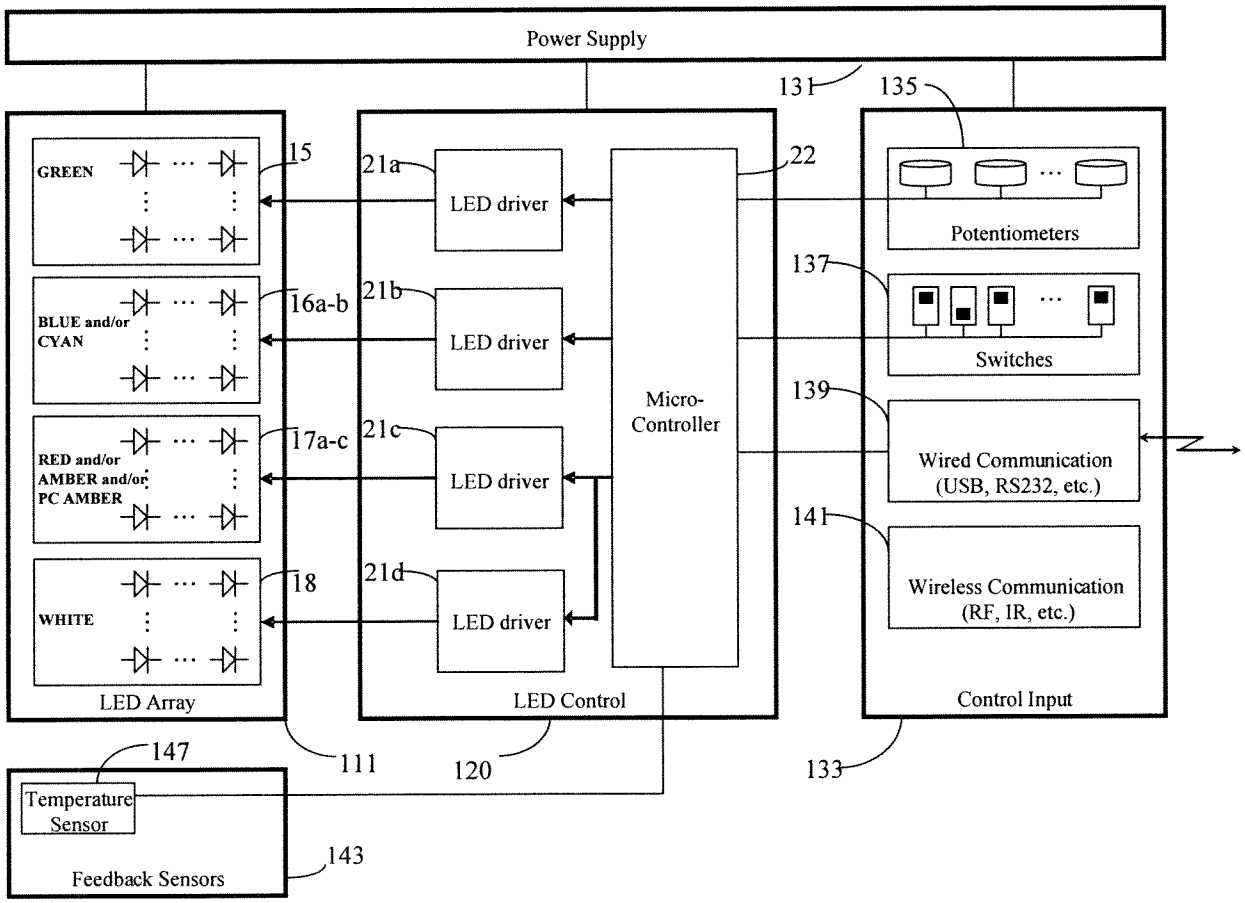
FIG. 9 is a functional block diagram of the electrical components of still another example of a light emitting system using programmable digital control logic, where four channels drive four color light sources, i.e., Green LEDs, a combination of a Blue and/or Cyan LEDs, a combination of Red and/or Amber and/or PC Amber LEDs, and White LEDs, respectively.

FIG. 9 is a block diagram of still another exemplary circuitry for light sources and associated control circuit, providing digital programmable control. This circuit example has a configuration similar to the configuration of the circuit example of FIG. 6, and where appropriate, similar elements are identified by the same reference numerals. Thus, the description of the same components as those of FIG. 6 will be omitted. The system 120 includes driver circuits 21*a*-21*d* for the various LEDs and the microcontroller 22. The system may also include one or more digital to analog converters (DACs) (not separately shown). In this regard, the microcontroller 22 may control the DACs, which in turn provide signals to the respective drivers 21*a* to 21*d*. The analog current output level of each of the driver circuits 21*a* to 21*d* may be controlled by a higher level logic of the system. The array 111 includes at least one Green LED in the first control channel (i.e., 15), at least one Blue LED and/or at least one Cyan LED in the second control channel (i.e., 16*a*-16*b*), at least one Red LED and/or at least one Amber LED and/or at least one Phosphor-Converted (PC) Amber LED in the third control channel (i.e., 17*a*-17*c*), and at least one White LED in the fourth control channel 18. The four driver circuits 21*a*-21*d* drive four color light sources, i.e., the Green LEDs 15, the Blue/Cyan LEDs 16*a*-16*b* and the Red/Amber/PC Amber LEDs 17*a*-17*c*, and the White LEDs 18, respectively. The microcontroller 22 receives control inputs specifying the particular 'recipe' or mixture. The input information will include or can be translated to color coordinates of a target point, for a desired color characteristic for the combined output light from the system. The input information may also indicate an overall intensity or dimming level. Then, the microcontroller 22 controls the LED driver circuits 21*a* to 21*d* accordingly, to set appropriate intensity levels for the LEDs 15 to 18 providing the light of the various colors. Referring to FIG. 9, the microcontroller 22 controls the four LED driver circuits 21*a*-21*d* through three logical channels (indicated by three control lines originated from the microcontroller 22 to the LED drivers 21*a*-21*c*). More particularly, the first and second logical channels are used to control the driver circuits 21*a* and 21*b*, respectively, while the third logical channel is used to commonly control the two driver circuits 21*c* and 21*d*. Thus, with this circuit configuration of FIG. 9, LED control algorithms based on three logical channels can be applied to the four color light sources 15-18. Furthermore, with an appropriate mapping between three logical channels and more than three color light sources, such control algorithms based on three logical channels can be applied to any number of color light sources, each source with any number of varieties of LEDs or other light emitters.

Similar color correction procedures can be implemented in any system having three or more channels of control of different color LED sources, such as in the four examples of FIGS. 6-9. It may be easiest to understand the nuances of the methodology using three primary colors, such as RGB, by way of an example. Hence, in the following paragraphs, an exemplary general lighting system for color correction with the circuit configuration of FIG. 6 will be described. However, this exemplary lighting system can operate with other circuit configurations, including the configuration of FIGS. 7-9, in a similar manner, e.g., only with changes in the configuration of the LEDs 15-17 (see FIGS. 7 and 8) or with an addition of more color light sources (see FIG. 9). That is, the microcontroller 22 is coupled to control the three LED elements 15-17 in the array 111 (as in FIGS. 6-8) or the three logical channels (as in FIG. 9) to produce a color corrected output light.

Referring to FIG. 6, in this exemplary lighting system, the microcontroller 22 is coupled to control the three LED elements 15-17 in the array 111 to produce a color corrected output light having a desired color characteristic corresponding to a target color point dimmed to a target proportion of a maximum target intensity. The target color point with the target proportion represents the desired color characteristic for a combined light output with the target proportion of the maximum target intensity, for which the LEDs 15-17 are controlled to produce a color corrected combined output light. In this exemplary lighting system, coordinates of the target color point are input to the microcontroller 22. The coordinates represent the target color point in a first color space, e.g., as an xy chromaticity point in CIE 1931 color space. The CIE 1931 color space defines a color point and intensity expressed as a CIE 1931 xyY chromaticity coordinate where the Y portion is a percentage of maximum intensity at that xy chromaticity. The target intensity proportion is also input to the microcontroller 22, e.g., as a fraction or percentage of a maximum intensity. In order to produce a color corrected light output for the target color point with the target intensity proportion, the microcontroller may perform a color correction, and control the LED drivers 21*a*-21*c* to adjust LED settings, e.g., to proportionally adjust input settings with the proportion of the maximum intensity for each type of LED light emission (e.g., Red, Green or Blue), based on a result of the color correction.

Figure 10A:
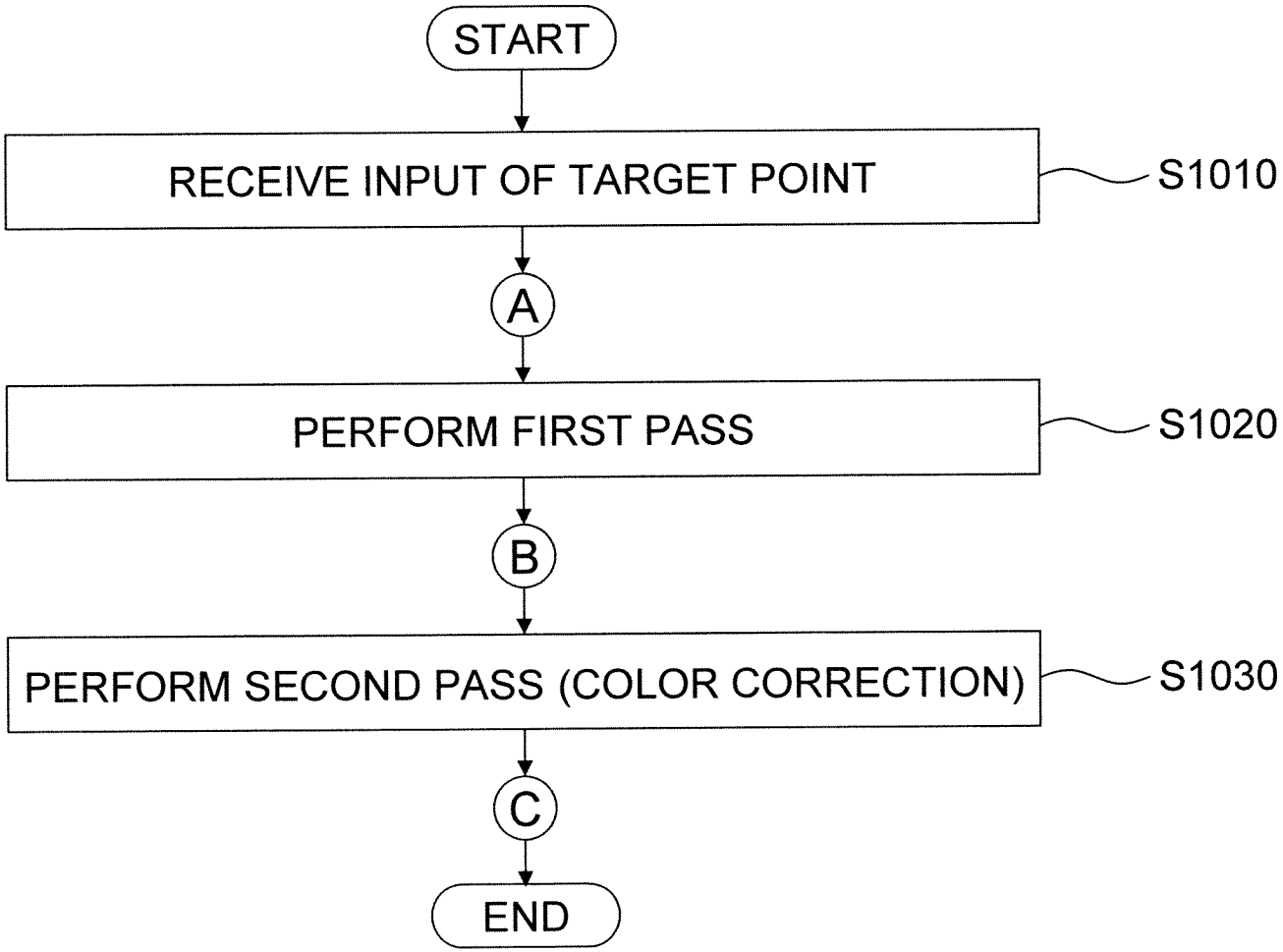
FIG. 10A is a flow chart, illustrating an example of a color correction method with two computation passes.
Figure 10B:
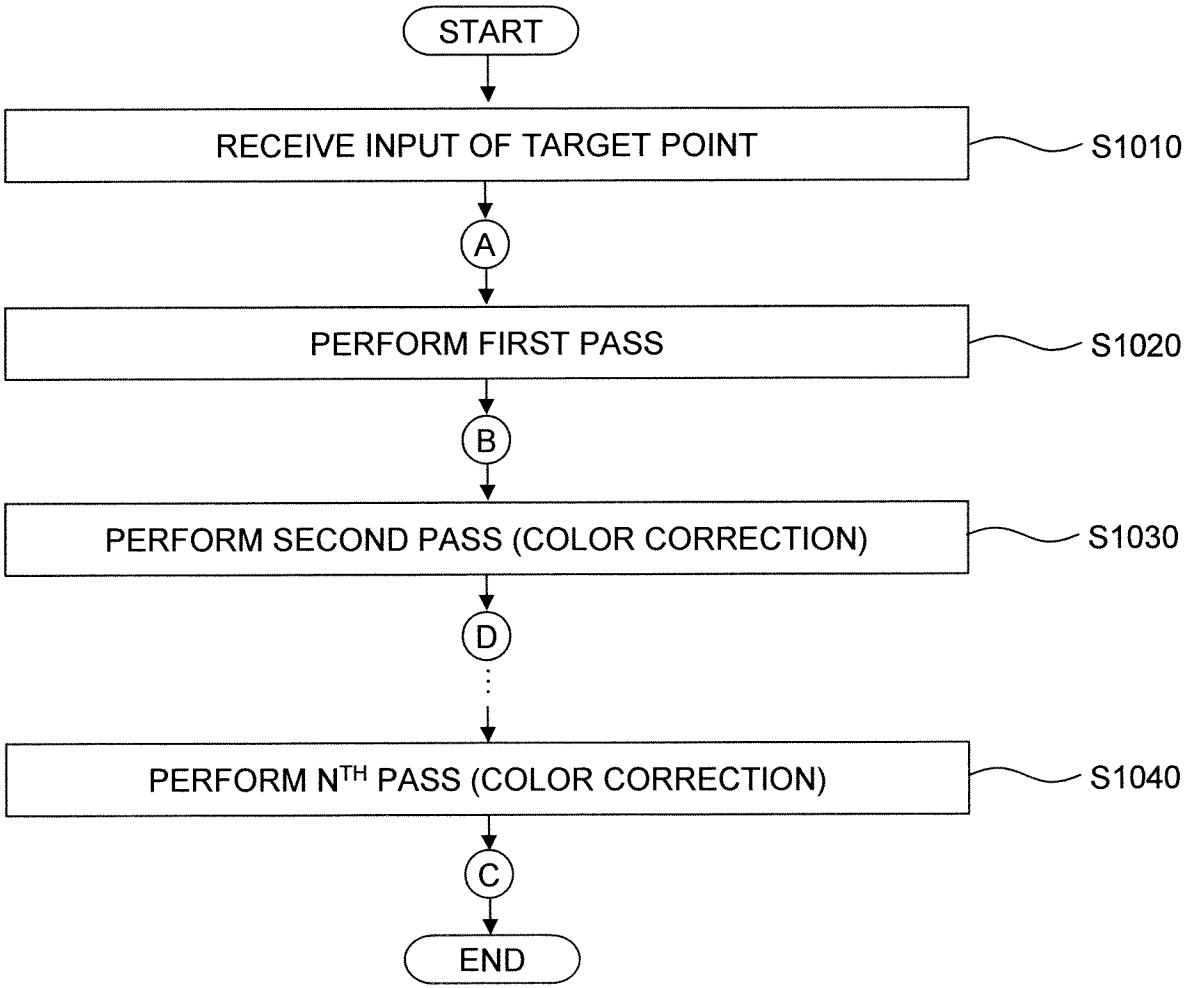
FIG. 10B is a flow chart, illustrating an example of a color correction method with n computation passes (n>2).

FIG. 10A is a flow chart, illustrating an example of a color correction method with two computation passes. Referring to FIG. 10A, in order to perform the color correction control, microcontroller 22 receives an input relating to or otherwise obtains color coordinates of the target point defined in the first color space, e.g., the CIE 1931 color space (S1010). The microcontroller 22 then performs two (first and second) computation passes (S1020 and S1030 in FIG. 10A) to determine respective driver settings for the LEDs 15-17 as will be described in the following paragraphs. Because the currents flowing through the LEDs at the LED settings as a result of the first computation pass and the current density thereof are not known until the first computation pass is completed, for improved accuracy, the microcontroller 22 performs the second computation pass (S1030) to correct for the effect of the current density reduction due to the proportionally adjusted input settings. In other words, the first pass output is a best guess, given the information at hand, while the second computation pass uses that information to perform the color correction control with the proportionally adjusted intensity settings of the LEDs at those current densities. Referring to FIG. 10B, this process may be iterative, so that a third computation pass (S1040) may result in even more accurate color corrected results.

Figure 11A:
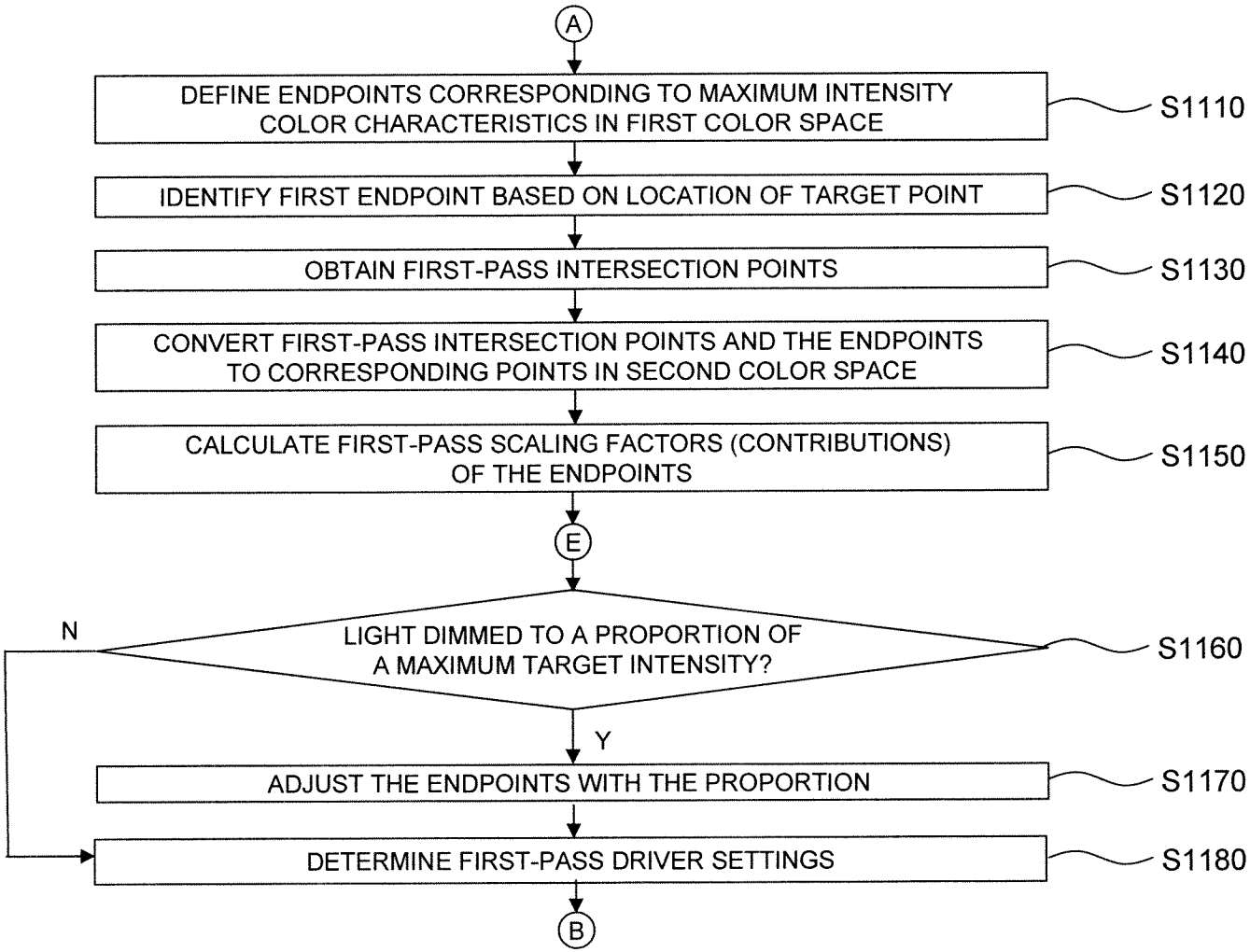
FIG. 11A is a flow chart, illustrating an example of the first computation pass of a color correction method.
Figure 11B:
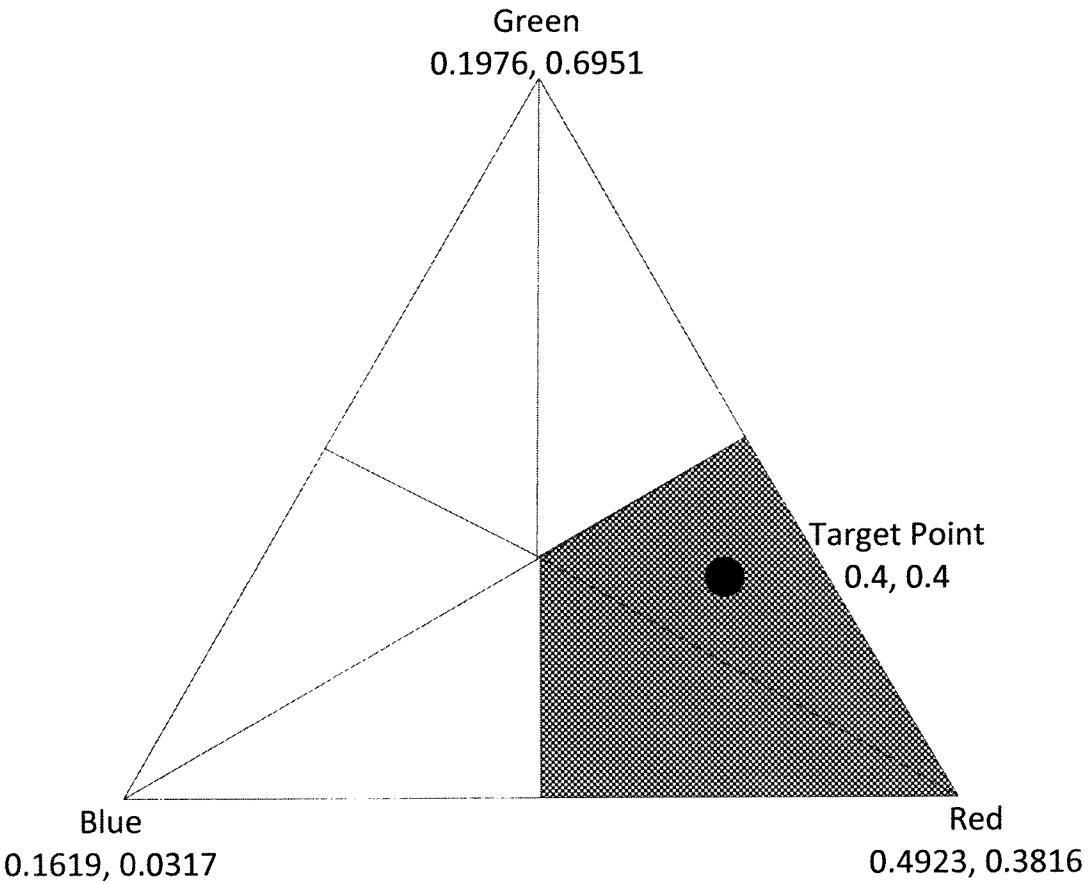
FIG. 11B is a color volume diagram, useful in understanding a step of the first computation pass of a color correction method, for determining a region of a target point in a first color space.

FIG. 11A is a flow chart, illustrating an example of the first computation pass of a color correction method. The color volume diagram of FIG. 11B illustrates a step of defining endpoints corresponding to maximum intensity color characteristics in the first color space (S1110 in FIG. 11A). More particularly, referring to FIG. 6, the microcontroller 22 first defines a first output volume (e.g., the triangular area with three vertices Red, Green and Blue, as shown in FIG. 11B) in the first color space to have boundaries with three endpoints, denoted by Red, Green and Blue in FIG. 11B. The Red, Green and Blue endpoints correspond to color characteristics of three color light sources, e.g., the Red LEDs 15, Green LEDs 16 and Blue LEDs 17 (see FIG. 6), respectively, when the LEDs 15-17 are operated at or near respective maximum intensities. That is, the first output volume defined with these endpoints represents an uncorrected color of a light emitted from the LEDs 15-17 that are full ON. Alternatively, the first volume is defined with the endpoints corresponding to the LEDs 15-17, at least one of which is full ON. Accounting for a desired light output of less than full ON of any colors will be accounted for later in the first computation pass. The first output volume may be pre-programmed into the programmable microcontroller 22 (see FIG. 6 and the related descriptions above).

Referring to FIG. 11B, the center point of the first output volume can either be the sum of the three endpoints or be based on pre-programmed data of the microcontroller 22. The microcontroller 22, after defining the first output volume, identifies a first endpoint, e.g., Red in FIG. 11B, among the three endpoints, as a region where the target point lies, based on the location of the target point (0.4, 0.4) in the first volume (S1120 in FIG. 11A).

The microcontroller 22, after determining the first endpoint, determines first-pass light amounts of respective maximum intensity light contributions from the LEDs 15-17 to achieve light at the target point. More particularly, the microcontroller 22 determines what the other two endpoints (e.g., Green and Blue), other than the identified first endpoint (e.g., Red), must contribute their respective maximum intensity amounts to achieve the desired target CIE1931 xy color point at (0.4, 0.4). In order to determine the respective first-pass light contribution amounts, the microcontroller 22 first obtains two first-pass intersection points (e.g., $\text{Target}_{rb}$) located in the first volume (S1130 in FIG. 11A), and then calculates respective first-pass scaling factors, i.e., respective first-pass light contribution amounts, based on the obtained the first-pass intersection points (S1150 in FIG. 11A).

Figure 11C:
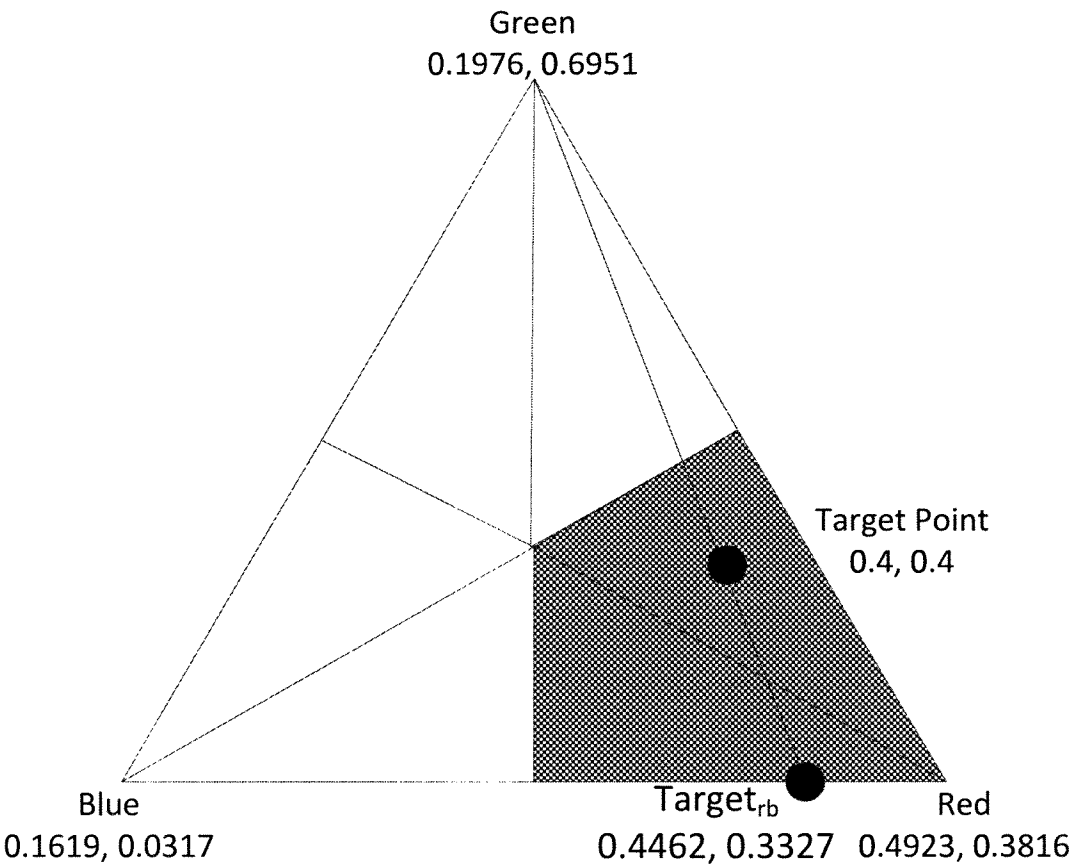
FIG. 11C is a color volume diagram, useful in understanding another step of the first computation pass of a color correction method, for obtaining a first-pass intersection point.

The color volume diagram of FIG. 11C illustrates a step of obtaining the first-pass intersection points (S1130 in FIG. 11A). In this step, the microcontroller 22 obtains a first first-pass intersection point (e.g., $\text{Target}_{rb}$ in FIG. 11C), at which a line connecting the target point and the Green endpoint intersects a boundary line connecting the identified first endpoint (Red) and the Blue endpoint. This first intersection point $\text{Target}_{rb}$ is used to calculate the amount of Blue that must be added to the FULL ON Red to produce the desired target point when Green is removed. Similarly, the microcontroller 22 obtains a second first-pass intersection point (e.g., $\text{Target}_{rg}$), at which a line connecting the target point and the Blue endpoint intersects a boundary line connecting the identified first endpoint (Red) and the Green endpoint. This second intersection point $\text{Target}_{rg}$ is used to calculate the amount of Green that must be added to the FULL ON Red to produce the desired target point when Blue is removed. The microcontroller 22 then converts the obtained two first-pass intersection points $\text{Target}_{rb}$ and $\text{Target}_{rg}$, and the Red, Blue and Green endpoints, into corresponding points in a second color space, e.g., the CIE Tristimulus XYZ color space (S1140 in FIG. 11A). For example, a point $[x\ y\ Y_1]^{-1}$ in CIE xyY coordinates can be converted to a converted point $[X\ Y_2\ Z]^{-1}$ in CIE Tristimulus XYZ color space using Equation (1). This conversion is performed, because the CIE XYZ color space is more uniform with intensity than the CIE xyY color space (chromaticity plus intensity), thereby achieving higher accuracy and efficiency than the CIE xyY color space achieves.

$$X = Y_1 \times \frac{x}{y},\ Y_2 = Y_1,\ Z = Y_1 \times \frac{1-x-y}{y} \qquad \text{Equation (1)}$$

After the conversion is performed, the microcontroller 22 calculates respective first-pass scaling factors $S_b$ and $S_g$ of the converted Blue and Green endpoints using Equations (2) and (3), respectively (S1150 in FIG. 11A). That is, each of the converted first-pass intersection points (e.g., $[X_{trb}\ Y_{trb}\ Z_{trb}]^{-1}$ and $[X_{trg}\ Y_{trg}\ Z_{trg}]^{-1}$) is obtained by adding, to the converted first endpoint (e.g., $[X_r\ Y_r\ Z_r]^{-1}$), one of the converted Blue endpoint multiplied by the first-pass scaling factor thereof (e.g., $S_b \times [X_b\ Y_b\ Z_g]^{-1}$), and the converted Green endpoint multiplied by the first-pass scaling factor thereof (e.g., $S_g \times [X_g\ Y_g\ Z_g]^{-1}$). Each of these scaling factors depicts the percentage contribution of each of the Blue and Green endpoints to produce the desired target point. The microcontroller 22 may also calculate the first-pass scaling factor $S_r$ of the Red endpoint, which may be 1, i.e., 100% contribution to produce the desired target point.

$$\begin{bmatrix} X_r \\ Y_r \\ Z_r \end{bmatrix} + \begin{bmatrix} X_b \\ Y_b \\ Z_b \end{bmatrix} \times S_b = \begin{bmatrix} X_{trb} \\ Y_{trb} \\ Z_{trb} \end{bmatrix}, \qquad \text{Equation (2)}$$

$$S_b = \frac{y_b X_r - x_b Y_r}{x_b Y_b - y_b X_b}$$

where $$x_b = \frac{X_{trb}}{X_{trb} + Y_{trb} + Z_{trb}},\ y_b = \frac{Y_{trb}}{X_{trb} + Y_{trb} + Z_{trb}}$$

$$\begin{bmatrix} X_r \\ Y_r \\ Z_r \end{bmatrix} + \begin{bmatrix} X_g \\ Y_g \\ Z_g \end{bmatrix} \times S_g = \begin{bmatrix} X_{trg} \\ Y_{trg} \\ Z_{trg} \end{bmatrix}, \qquad \text{Equation (3)}$$

$$S_g = \frac{y_g X_r - x_g Y_r}{x_g Y_g - y_g X_g}$$

where $$x_g = \frac{X_{trg}}{X_{trg} + Y_{trg} + Z_{trg}},\ y_g = \frac{Y_{trg}}{X_{trg} + Y_{trg} + Z_{trg}}$$

For example, the Red endpoint $[0.4923\ 0.3816\ 894]^{-1}$ converts to $[X_r\ Y_r\ Z_r]^{-1} = [1154\ 894\ 295]^{-1}$, and the Blue endpoint $[0.1619\ 0.0317\ 71]^{-1}$ converts to $[X_b\ Y_b\ Z_b]^{-1} = [361\ 71\ 1801]^{-1}$. With these converted points, the first-pass scaling factor $S_b = 0.1705$ is obtained using Equation (2).

The microcontroller 22, after calculating the first-pass scaling factors, determines whether the target proportion of the maximum target intensity is input to the microcontroller 22 (S1160 in FIG. 11A). When it is determined that the target proportion is not given as input to the microcontroller 22, the microcontroller 22 then determines first-pass driver settings, i.e., initial driver settings, for the LEDs 15-17 based only on the determined first-pass scaling factors $S_r$, $S_g$ and $S_b$ (S1180 in FIG. 11A). When it is determined that the target proportion, e.g., Q (%), is given as input to the microcontroller 22, before the first-pass driver settings are determined (S1180 in FIG. 11A), the microcontroller 22 adjusts the converted endpoints in accordance with the determined first-pass scaling factors $S_r$, $S_g$ and $S_b$ and with the target proportion Q (%) (S1170 in FIG. 11A). More particularly, in performing the adjustment (S1170 in FIG. 11A), the converted first (e.g., Red) endpoint is multiplied by its first-pass scaling factor $S_r$ and by the target proportion Q. Similarly, the converted Blue endpoint is multiplied by its first-pass scaling factor $S_b$ and by the target proportion Q, and the converted Green endpoint is multiplied by its first-pass scaling factor $S_g$ and by the target proportion Q. Alternatively, instead of scaling all of X, Y, Z Tristimulus coordinates of each endpoint by its scaling factor and the target proportion, only one of the three Tristimulus coordinates may be scaled. The largest Tristimulus among three coordinates may be chosen for a higher level of accuracy. For example, a Blue endpoint typically has a higher Z Tristimulus than X or Y, thus only $Z_b$ is chosen to be scaled using Equation (4). When the target proportion Q=50%, the scaled $Z_b = Z_{b,scaled} = 1801 \times 0.1705 \times 50/100 = 153.5$ is obtained using Equation (4).

$$Z_b \times S_b \times \frac{\%\ Q}{100} = Z_{b,scaled} \qquad \text{Equation (4)}$$

In order to determine the first-pass driver settings for the LEDs 15-17 (S1180 in FIG. 11A), the microcontroller converts the scaled Tristimulus for each endpoint into a driver setting. The conversion is performed using pre-programmed data, which are based on manufacturer performance data or actual measured performance data. Such pre-programmed data can take many forms, including a look up table which may or may not include interpolation, or transfer functions. For example, the following Function (1) expresses a transfer function whose output is the driver setting value for a Blue LED for an input argument a of a scaled Tristimulus $Z_{b,scaled}$. Using Function (1), when $Z_{b,scaled} = 153.5$, the Blue LED driver setting value of 55186 can be obtained.

$$0.000635\alpha^2 - 34.07 \times \alpha + 60401 \qquad \text{Function (1)}$$

At this stage, three first-pass driver channel settings for the LEDs 15-17 (see FIG. 6) have been calculated, assuming that the first output volume is generated with each LED channel full ON. If these three LEDs were to be set at the above-calculated first-pass driver settings, the lighting system would still produce an uncorrected light output, because the changes in chromaticity of the LEDs due to the current density reduction with the proportionally adjusted driver settings (e.g., driver settings obtained using Equation (4) and Function (1)) would not be accounted for. To account for the effects of the current density reduction, the second computation pass may be performed as will be described in the following paragraphs.

Figure 12A:
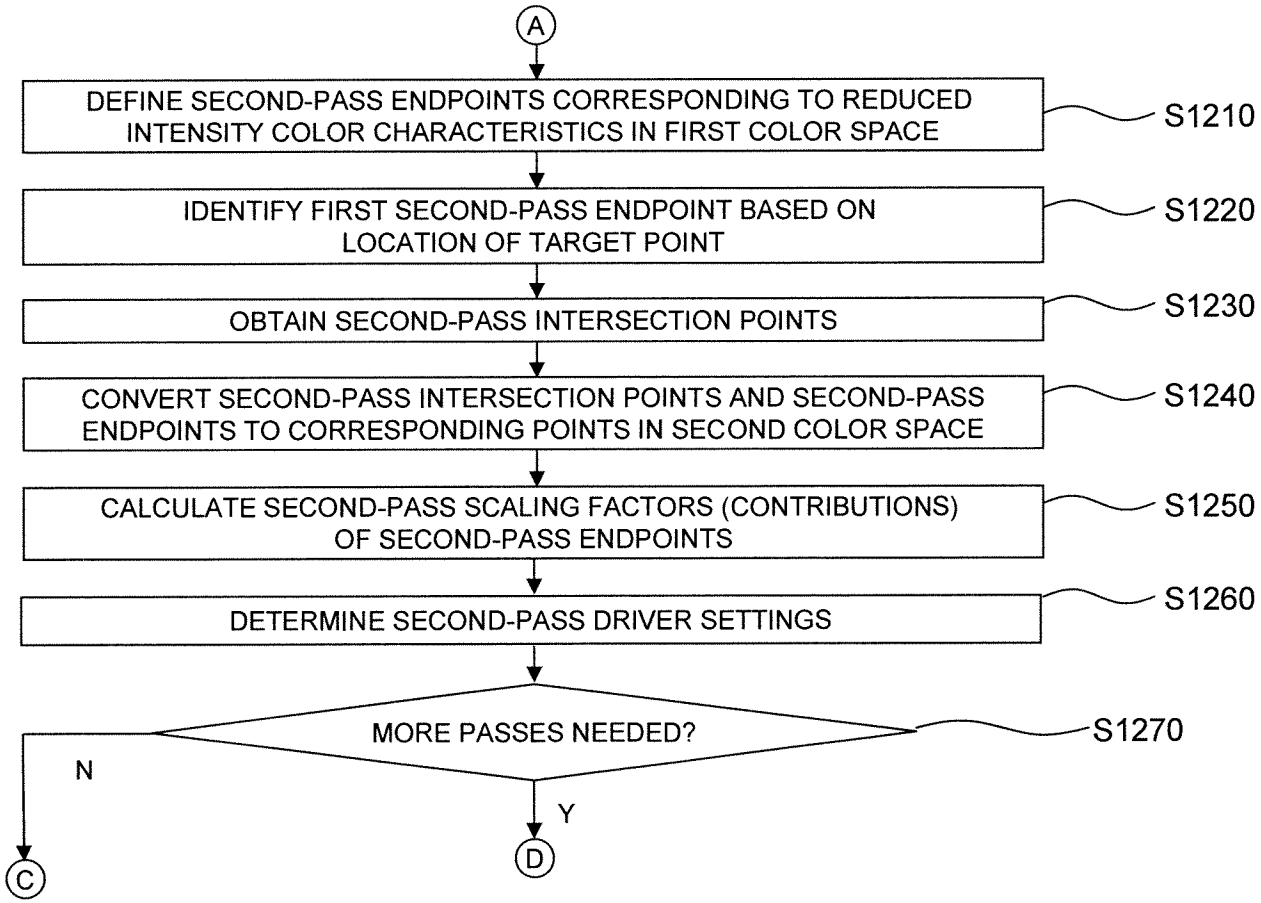
FIG. 12A is a flow chart, illustrating an example of the second computation pass of a color correction method.
Figure 12B:
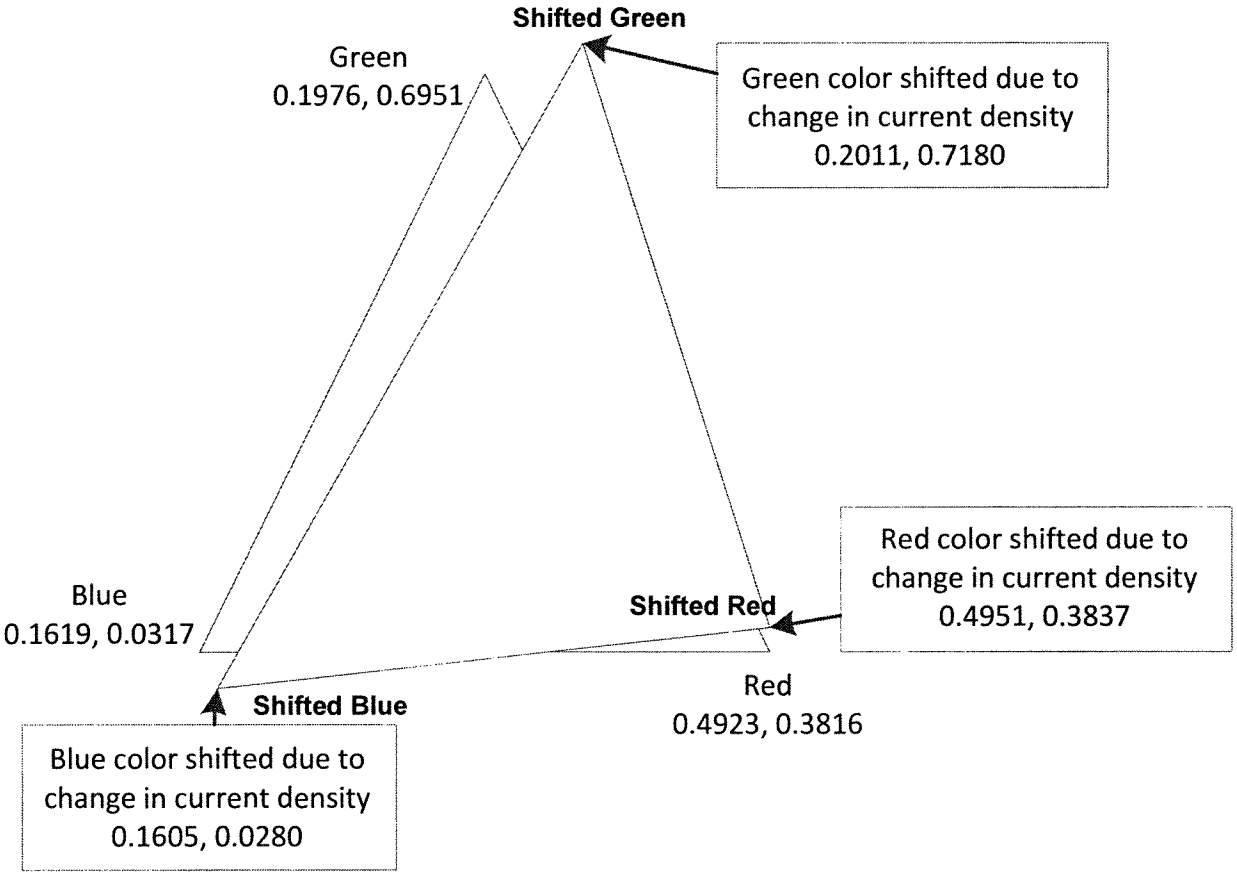
FIG. 12B is a color volume diagram, useful in understanding a step of the second pass of a color correction method, for defining three endpoints based on driver settings determined in the first computation pass.

FIG. 12A is a flow chart, illustrating an example of the second computation pass of a color correction method. The color volume diagram of FIG. 12B illustrates a step of defining second-pass endpoints corresponding to reduced intensity color characteristics in the first color space (S1210 in FIG. 12A). In this step, the microcontroller 22 defines a second output volume (e.g., the new triangular area overlaying the triangular area of the first output volume, as shown in FIG. 12B) to have boundaries with three endpoints (those denoted by Shifted Red, Shifted Green and Shifted Blue in FIG. 12B). Those Shifted Red, Green and Blue endpoints correspond to color characteristics of three color light sources, e.g., the Red LEDs 15, Green LEDs 16 and Blue LEDs 17 (see FIG. 6), respectively, when the LEDs 15-17 are operated at the first-pass driver settings, which have been determined in the first computation pass. Since the adjustment has been performed with a reduced portion of the maximum target intensity in the first computation pass, the Shifted endpoints correspond to reduced color characteristics of the Red LEDs 15, Green LEDs 16 and Blue LEDs 17. That is, this second output volume represents an uncorrected color of a light emitted from the LEDs 15-17 that are driven with the driver settings, determined or adjusted in the first computation pass.

More particularly, this new second output volume may be established based on the resulting output of the first computation pass, using pre-programmed performance data. These performance data provide a relationship between the driver setting for each LED and the XYZ Tristimulus output of the lighting system. For example, the following Function (2) expresses a transfer function whose output is the X Tristimulus coordinate $X_b$ for a Blue LED output for an input argument a of a driver setting value for the Blue LED output. Using Function (2), when $\alpha$=55186, the Tristimulus coordinate $X_b$=158.04 can be obtained. In this manner, nine transformations may be performed, three (one for X, one for Y, and one for Z) for each of the three colors. Further, the obtained three sets of XYZ Tristimulus coordinates are converted to CIE1931 xyY coordinates, thereby forming the new second output volume defined in the first color space.

$$3.57\times10^{-8}\times\alpha^2-0.03254\alpha+1845.14 \qquad \text{Function (2)}$$

Figure 12C:
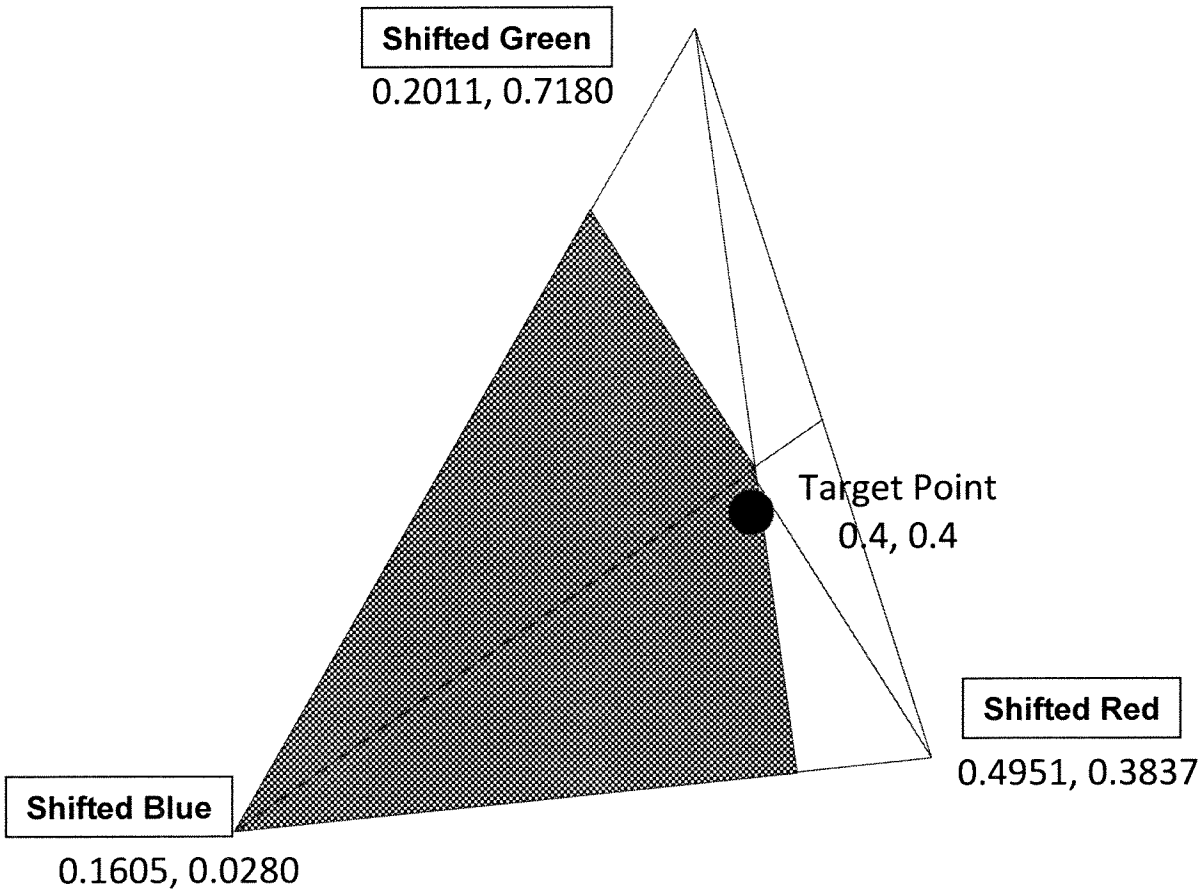
FIG. 12C is a color volume diagram, useful in understanding another step of the second computation pass of a color correction method, for determining a region of the target point in the first color space.

The color volume diagram of FIG. 12C illustrates a step of identifying a first second-pass endpoint based on location of the target point (S1220 in FIG. 12A). Referring to FIG. 12C, the center point of the second output volume can either be the sum of the three Shifted endpoints or be based on pre-programmed data of the microcontroller 22 (see FIG. 6 and the related description above). It is noted that the center point of the second output volume also has shifted due to dimmed lights output from the three LEDs 15-17 driven at the determined or adjusted driver settings of the first pass. The microcontroller 22 then identifies a first Shifted endpoint, e.g., Shifted Blue in FIG. 12C, among the three Shifted endpoints, as a region where the target point lies in the second volume, based on the location of the target point (0.4, 0.4) in the second volume.

The microcontroller 22, after determining the first Shifted endpoint, determines second-pass light amounts of respective reduced intensity light contributions from the LEDs 15-17 to achieve light at the target point, in a manner similar to that of the first pass. More particularly, the microcontroller 22 determines what the other two Shifted endpoints (e.g., Red and Green), other than the identified first Shifted endpoint (e.g., Blue), must contribute their respective reduced intensity amounts to achieve the desired target CIE1931 xy color point at (0.4, 0.4). In order to determine the respective second-pass light contribution amounts, the microcontroller 22 first obtains two second-pass intersection points (e.g., $\text{Target}_{rb}$ in FIG. 12D) located in the second volume, and then calculates respective second-pass scaling factors, i.e., respective second-pass light contribution amounts, based on the obtained the second-pass intersection points.

Figure 12D:
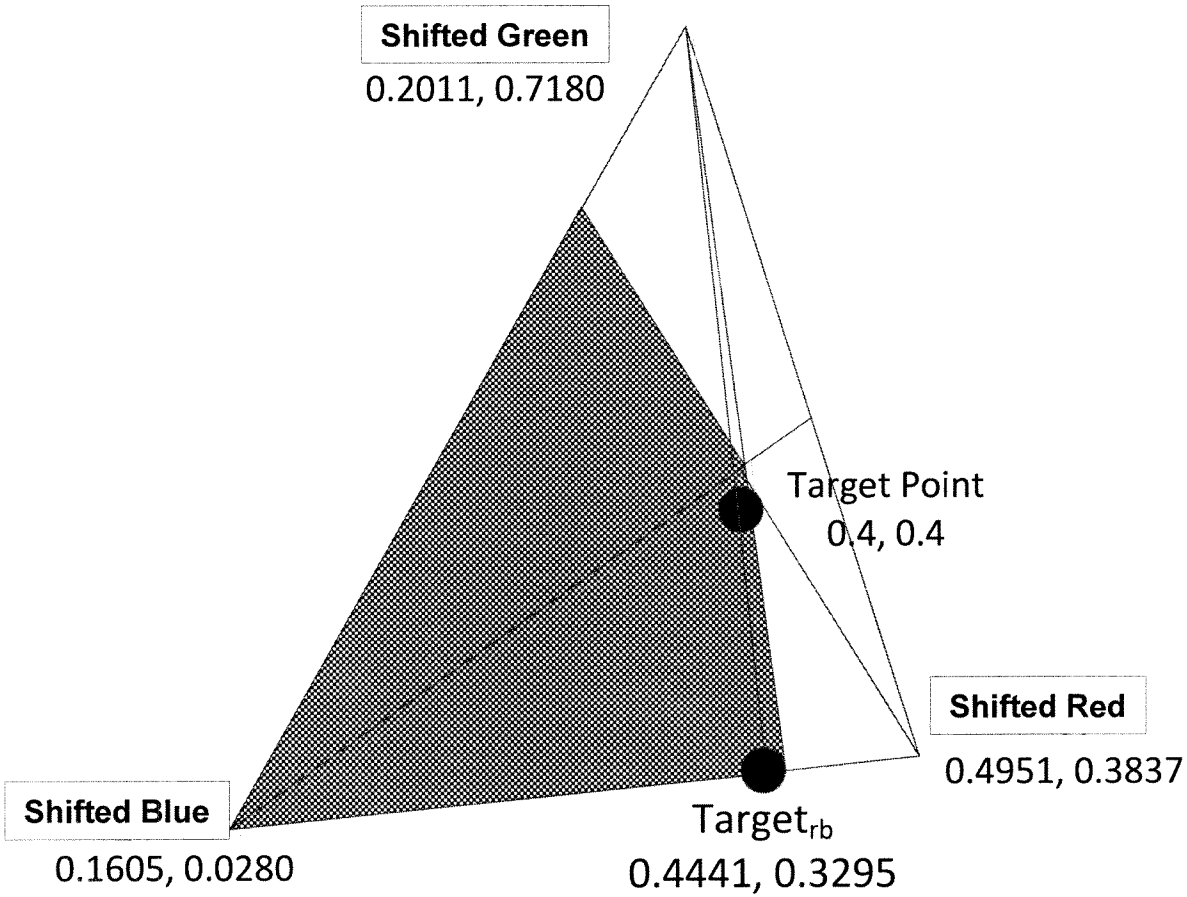
FIG. 12D is a color volume diagram, useful in understanding still another step of a color correction method, for obtaining a second-pass intersection point.

The color volume diagram of FIG. 12D illustrates a step of obtaining two second-pass intersection points (S1230 in FIG. 12A). In this step, the microcontroller 22 obtains a first second-pass intersection point (e.g., $\text{Target}_{rb}$ in FIG. 12D), at which a line connecting the target point and the Shifted Green endpoint intersects a boundary line connecting the identified first Shifted endpoint (Blue) and the Shifted Red endpoint. This first second-pass intersection point $\text{Target}_{rb}$ is used to calculate the amount of Shifted Red that must be added to the Shifted Blue to produce the desired target point when Shifted Green is removed. Similarly, the microcontroller 22 obtains a second second-pass intersection point (e.g., $\text{Target}_{gb}$), at which a line connecting the target point and the Shifted Red endpoint intersects a boundary line connecting the identified first endpoint (Blue) and the Shifted Green endpoint. This second intersection point $\text{Target}_{gb}$ is used to calculate the amount of Shifted Green that must be added to the Shifted Blue to produce the desired target point when Shifted Red is removed. The microcontroller 22 then converts the obtained two second-pass intersection points $\text{Target}_{rb}$ and $\text{Target}_{gb}$, and the Shifted Red, Shifted Blue and Shifted Green endpoints, into corresponding points in the second color space, e.g., the CIE Tristimulus XYZ color space (S1240 in FIG. 12A), using Equation (1). This conversion is performed, because the CIE XYZ color space is more uniform with intensity than the CIE xyY color space (chromaticity plus intensity), thereby achieving higher accuracy and efficiency than the CIE xyY color space achieves.

After the conversion is performed, the microcontroller 22 calculates respective second-pass scaling factors $S_r$ and $S_g$ of the converted Shifted Red and Green endpoints using Equations (5) and (6), respectively, which are similar to Equations (2) and (3) (S1250 in FIG. 12A). That is, each of the converted second-pass intersection points (e.g., $[X_{trb}\ Y_{trb}\ Z_{trb}]^{-1}$ and $[X_{tgb}\ Y_{tgb}\ Z_{tgb}]^{-1}$) is obtained by adding, to the converted first second-pass endpoint (e.g., Shifted Blue, $[X_b\ Y_b\ Z_b]^{-1}$, one of the converted Shifted Red endpoint multiplied by the second-pass scaling factor thereof (e.g., $S_r\times[X_r\ Y_r\ Z_r]^{-1}$), and the converted Shifted Green endpoint multiplied by the second-pass scaling factor thereof (e.g., $S_g\times[X_g\ Y_g\ Z_g]^{-1}$). Each of these second-pass scaling factors depicts the percentage contribution of each of the Shifted Red and Shifted Green endpoints to produce the desired target point. The microcontroller 22 may also calculate the second-pass scaling factor $S_b$ of the Shifted Blue endpoint, which may be 1, i.e., 100% contribution to produce the desired target point.

$$\begin{bmatrix} X_b \\ Y_b \\ Z_b \end{bmatrix} + \begin{bmatrix} X_r \\ Y_r \\ Z_r \end{bmatrix} \times S_r = \begin{bmatrix} X_{trb} \\ Y_{trb} \\ Z_{trb} \end{bmatrix}, \qquad \text{Equation (5)}$$

$$S_r = \frac{y_r X_b - x_r Y_b}{x_r Y_r - y_r X_r}$$

where $$x_r = \frac{X_{trb}}{X_{trb} + Y_{trb} + Z_{trb}},\ y_r = \frac{Y_{trb}}{X_{trb} + Y_{trb} + Z_{trb}}$$

$$\begin{bmatrix} X_b \\ Y_b \\ Z_b \end{bmatrix} + \begin{bmatrix} X_g \\ Y_g \\ Z_g \end{bmatrix} \times S_g = \begin{bmatrix} X_{tgb} \\ Y_{tgb} \\ Z_{tgb} \end{bmatrix}, \qquad \text{Equation (6)}$$

$$S_g = \frac{y_g X_b - x_g Y_b}{x_g Y_g - y_g X_g}$$

where $$x_g = \frac{X_{tgb}}{X_{tgb} + Y_{tgb} + Z_{tgb}},\ y_g = \frac{Y_{tgb}}{X_{tgb} + Y_{tgb} + Z_{tgb}}$$

For example, the Shifted Red endpoint $[0.4951\ 0.3837\ 444]^{-1}$ converts to $[X_r\ Y_r\ Z_r]^{-1}=[573\ 444\ 140]^{-1}$, and the Shifted Blue endpoint $[0.1605\ 0.0280\ 5]^{-1}$ converts to $[X_b\ Y_b\ Z_b]^{-1}=[31\ 5\ 158]^{-1}$. With these converted points, the second-pass scaling factor $S_r$=0.9359 is obtained using Equation (5).

The microcontroller 22, after calculating the second-pass scaling factors, determines second-pass driver settings, i.e., color corrected driver settings, for the LEDs 15-17 based on the determined second-pass scaling factors $S_r$, $S_g$ and $S_b$ (S1260 in FIG. 12A). It is noted that unlike the first computed pass, each converted Shifted endpoints is not scaled based on the target proportion of the maximum target intensity. That is, the microcontroller 22 adjusts the converted Shifted endpoints only in accordance with the determined second-pass scaling factors $S_r$, $S_g$ and $S_b$. More particularly, the converted Shifted Red endpoint is multiplied by its second-pass scaling factor $S_r$ using Equation (7). Similarly, the converted Shifted first (e.g., Blue) endpoint is multiplied by its second-pass scaling factor $S_b$, and the converted Shifted Green endpoint is multiplied by its second-pass scaling factor $S_g$. For example, when the X Tristimulus coordinate $X_r$=573 and the corresponding second-pass scaling factor $S_r$=0.9359, the scaled $X_r=X_{r,scaled}$=573×0.9359=536 is obtained using Equation (7).

$$X_r \times S_r = X_{r,scaled} \quad \text{Equation (7)}$$

In order to determine the second-pass driver settings for the LEDs 15-17, the microcontroller converts the scaled Tristimulus for each Shifted endpoint into a second-pass driver setting. The conversion is performed using pre-programmed data, which are based on manufacturer performance data or actual measured performance data. Such pre-programmed data can take many forms, including a look up table which may or may not include interpolation, or transfer functions. For example, the following Function (3) expresses a transfer function whose output is the second-pass driver setting value for a Red LED for an input argument a of a scaled Tristimulus $X_{r,scaled}$. Using Function (3), when $X_{r,scaled}$=536, the Shifted Red LED driver setting value of 34399 can be obtained.

$$-0.00319\alpha^{-2}-46.94\alpha+60475 \quad \text{Function (3)}$$

After the second-pass driver settings are determined, it is determined whether one or more passes are needed (S1270 in FIG. 12A). When it is determined that one or more passes are needed, the controller 22 performs the third computation pass (e.g., S1040 in FIG. 10A). Otherwise, by applying the determined second-pass driver settings to drive the LEDs 15-17, the lighting system can produce a color corrected output light having a desired color characteristic corresponding to the target point dimmed to the target proportion of the maximum target intensity.

Figure 13:
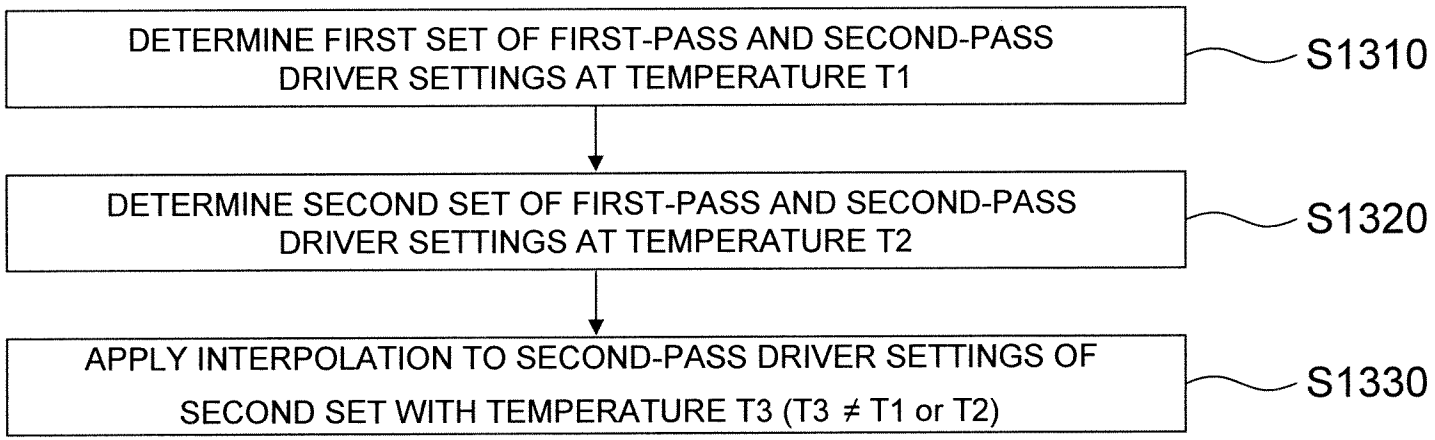
FIG. 13 is a flow chart, illustrating an example of a temperature correction extension of a color correction method.

FIG. 13 is a flow chart, illustrating an example of a temperature correction extension of the above-described color correction systems and methods. For example, referring to FIGS. 6-9, the microcontroller 22 controls the LEDs 15-17 or the LEDs 15-18 in the array 111 to correct for output changes of LEDs due to temperature changes. More particularly, the microcontroller 22 uses data on operation of the LEDs 15-17 or the LEDs 15-18 at a temperature $T_1$ to determine a first set of both the adjusted first-pass driver settings and the second-pass driver settings for the LEDs 15-17 or the LEDs 15-18 (S1310 in FIG. 13). Then, the microcontroller 22 uses data on operation of the LEDs 15-17 or the LEDs 15-18 at a temperature $T_2$ to determine a second set of both the adjusted first-pass driver settings and the second-pass driver settings for the LEDs 15-17 (S1320 in FIG. 13). The microcontroller 22 then applies an interpolation to at least the determined second-pass driver settings of the second set according to $T_3$, thereby obtaining an estimated set of second-pass driver settings for the LED system at $T_3$ (S1330 in FIG. 13). That is, multiple sets of pre-programmed performance data at different temperatures are created, and then the above-described color correction method is performed separately on multiple sets of data. Further, an interpolation is used on the multiple final driver settings. While any number of sets of data could be used, due to the linear nature of LED output performance changes over temperature, only two data sets may be used. The temperatures for these two data sets may be at opposite ends of the temperature operation range. The interpolation may be performed thereon linearly. Alternatively, referring to FIGS. 6-9, the microcontroller 22 may use performance data measured when the temperature sensor 147 provides a signal representing the measured temperatures of $T_1$, $T_2$ and $T_3$, to the microcontroller 22.

For another example of the temperature correction extension, a lighting system is first loaded with a first set of pre-programmed data measured at a certain temperature, 25° C. Next, the lighting system is loaded with an entire second set of pre-programmed data measured at 45° C. During operation, when a target CIE 1931 chromaticity point is inputted to the lighting system, the above-described first and second computation passes will be performed separately on the two sets of pre-programmed data. More particularly, the first and second passes will be performed using the 25° C. pre-programmed data, and then the first and second passes will be performed using the 45° C. pre-programmed data. As a result, two sets of driver channel settings are produced. Then, the actual temperature of the lighting system is measured with the temperature sensor 147 (see FIGS. 6-9). A linear interpolation of the two results sets may be used, based on the actual temperature of the lighting system. Alternatively, the lighting system uses a closed-loop feedback system to periodically monitor temperature changes and repeatedly perform, when the temperature changes, a color correction method to correct for the temperature change.

Figure 14:
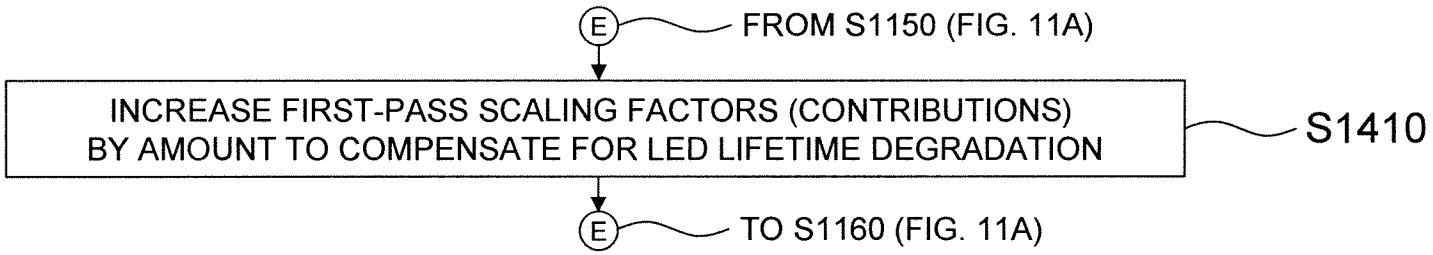
FIG. 14 is a flow chart, illustrating an example of a lifetime degradation correction extension of a color correction method.

FIG. 14 is a flow chart, illustrating an example of a lifetime degradation correction extension of the above-described color correction systems and methods. For example, referring to FIGS. 6-9, the microcontroller 22 controls the LEDs 15-17 or the LEDs 15-18 in the array 111 to correct for an output change due to an LED lifetime degradation during a particular period. More particularly, after calculating first-pass scaling factors (S1150 in FIG. 11A) and before determining whether a target proportion of a maximum target intensity is input to the microcontroller 22 (S1160 in FIG. 11A) in the first pass, the microcontroller 22 increases the determined first-pass scaling factors by an amount to compensate for the LED lifetime degradation during the particular period (S1410 in FIG. 14). Alternatively, in combination with this scaling compensation scheme, the microcontroller 22 uses data from a color sensor or use LED lifetime data to correct for lifetime degradation. For another example, if manufacturer's estimates show that after twenty thousand hours the Blue LED lumen output will have degraded by one percent, after twenty thousand hours of operation, in the above-described first computation pass, the scaling factor for the Blue LED will be bolstered by one percent to compensate.

The disclosed systems and methods may require pre-programmed performance data. These data are used for specifying the endpoints of the output volume and establishing the relationships between the driver settings and the Tristimulus XYZ light output. These performance data may simply be LED performance data directly from the manufacturer. Additional factors, such as optical performance, may be incorporated into these data as well. Alternatively, a test lot can be used, where a fixed number of lighting systems are measured and those data are used as performance data for all the lighting systems. Another option will be to calibrate each lighting system individually for improved accuracy. Calibration is an extra step that takes place as part of the lighting system manufacturing process, before the system is shipped. Calibration may use an external light meter such as a spectral radiometer to measure the light output of the individual channels of the LEDs at multiple current levels. Data from these measurements are used to create the pre-programmed data used for the disclosed systems and methods. Calibration can be used to improve the accuracy of temperature corrections as well. After taking these measurements, the measured data are programmed into the non-volatile memory coupled to the microcontroller 22 (see FIGS. 6-9 and the related descriptions above). Calibration may tailor the performance data used for color correction for each individual lighting system, instead of making a generalization based on historic LED performance, thereby resulting in more accurate results.

When transfer functions are used to establish the relationship between the Tristimulus XYZ light output and the driver settings, it may be difficult to obtain a highly representative transfer function, because obtaining a transfer function significantly depends upon the performance of the LEDs. If the lighting system is calibrated with equipment, e.g., an external light meter, the performance of that equipment also may substantially contribute to the difficulty of obtaining a transfer function. In the above-noted examples (e.g., Functions (1)-(3)), $2^{nd}$ order curve fits are used to generate transfer functions. However, in some cases, $3^{rd}$ order curve fits may produce better results. In some other cases, even a $1^{st}$ order curve fit may suffice. Any form of curve fitting, such as polynomial, logarithmic, etc. may be used as is appropriate for the data set. Additionally, different parts of the curve can use different curve fits. For example, because the output of the LEDs changes drastically as the LED approaches an off state, an alternate curve fit may be used for current levels below a certain threshold, thereby providing a higher accuracy when the LEDs are at a very low intensity which is important for highly saturated colors. Furthermore, referring to FIGS. 6-9, performance characteristics of the LEDs 15-17 or the LEDs 15-18 as well as processing power of the controller chip of the microcontroller 22 may need to be considered when deciding what type of pre-programmed performance data and curve fit to use.

The disclosed systems and methods use a two (or more) pass approach to determine color corrected driver settings based on a target CIE 1931 input in a multi-color lighting system. The disclosed systems and methods also use at least three logical control channels to correct for changes in LED output due to current density, thereby allowing for the use of Analog Dimming LED drivers. The disclosed systems and methods calculate an optimal contribution of each LED input to achieve a desired target color characteristic of a combined light output. The disclosed systems and methods may operate on actual measured LED performance data, whether provided by the LED manufacturer or collected by other means, e.g., measurements. With the disclosed system and methods, multi-color LED systems can achieve greater color and lumen accuracy than conventional systems for the use of Analog Dimming LED drivers.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," "includes," "including," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

Unless otherwise stated, any and all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed is:

1. A method for controlling a multi-color lighting system for combining light from multiple color sources to produce light of a desired color characteristic, wherein the lighting system comprises three light sources each for producing light of a different one of three colors, each light source comprising one or more light emitters, the method comprising the steps of:

receiving an input relating to color coordinates of a target point defined in a first color space;

defining, in the first color space, a first volume having boundaries with endpoints corresponding to color characteristics of the light sources when operated at or near respective maximum intensities;

from the first volume, determining first-pass light amounts of respective maximum intensity light contributions from the light sources to achieve light at the target point;

determining first-pass driver settings for the light sources based on the determined first-pass light amounts;

when the light is to be dimmed to a proportion of the maximum target intensity, adjusting the first-pass driver settings in accordance with the determined first-pass light amounts and the proportion of the maximum target intensity;

defining, in the first color space, a second volume having boundaries with endpoints corresponding to reduced intensity color characteristics of the light sources when operated at the adjusted first-pass driver settings;

from the second volume, determining second-pass light amounts of respective reduced intensity light contributions from the light sources to achieve light at the target point;

determining second-pass driver settings for the light sources based on the determined second-pass light amounts; and applying the second-pass driver settings to drive the light sources to produce a color corrected output light having a color characteristic corresponding to the target point dimmed to the proportion of the maximum target intensity.

2. The method of claim 1, further comprising performing one or more passes of determining one or more further-pass driver settings based on the second-pass driver settings.

3. The method of claim 1, further comprising a step of correcting for output changes of the light emitters due to temperature changes.

4. The method of claim 3, wherein:

the determining of the first set of both the adjusted first-pass driver settings and the second-pass driver settings for the lighting system uses data on operation of the light emitters at a first temperature, and the correcting step comprises:

determining a second set of both adjusted first-pass driver settings and second-pass driver settings for the lighting system using data on operation of the light emitters at a second temperature; and applying an interpolation to at least the determined second-pass driver settings of the second set according to a third temperature that is different from the first and second temperatures, to obtain an estimated set of second-pass driver settings for the lighting system at the third temperature.

5. The method of claim 1, further comprising a step of correcting for an output change due to a lifetime degradation of the light emitters during a particular period.

6. The method of claim 5, wherein the correcting step comprises increasing the determined first-pass light amounts used in the adjusting step by an amount to compensate for the lifetime degradation during the particular period.

7. The method of claim 1, further comprising the steps of:

obtaining first-pass intersection points located in the first volume, at each of which a boundary line connecting a first one of the endpoints corresponding to the maximum intensity color characteristics of the light sources and a second one of the endpoints, intersects a line connecting the target point and a third one of the endpoints; and converting the obtained first-pass intersection points and the first, second and third endpoints, into corresponding points defined in a second color space, wherein the adjusting step comprises:

calculating respective first-pass scaling factors of the converted second and third endpoints such that each of the converted first-pass intersection points is obtained by adding, to the converted first endpoint, one of the converted second endpoint multiplied by the respective first-pass scaling factor thereof and the converted third endpoint multiplied by the respective first-pass scaling factor thereof;

multiplying the converted first endpoint by the proportion of the maximum target intensity to adjust a first one of the first-pass driver settings; and multiplying each of the converted second and third endpoints by the respective first-pass scaling factor thereof and by the proportion of the maximum target intensity, to adjust second and third ones of the first-pass driver settings.

8. The method of claim 1, wherein one of the three light sources for producing light of a particular one of the three colors includes at least two light sources, each comprising one or more light emitters, and the applying step comprises applying the second-pass driver settings to drive the at least two light sources to produce a corrected output light of the particular color.

9. A method for controlling a multi-color lighting system for combining light from multiple color sources to produce light of a desired color characteristic, wherein the lighting system comprises three light sources each for producing light of a different one of three colors, each light source comprising one or more light emitters, the method comprising the steps of:

receiving an input relating to color coordinates of a target point defined in a first color space;

defining, in the first color space, a first volume having boundaries with endpoints corresponding to color characteristics of the light sources when operated at or near respective maximum intensities, the first volume representing an uncorrected color of a light emitted from the lighting system with a maximum target intensity;

based on location of the target point in the first volume, identifying a first one of the maximum intensity color characteristics;

obtaining one first-pass intersection point located in the first volume, at which a line connecting the target point and the endpoint corresponding to a second one of the maximum intensity color characteristics, intersects a boundary line connecting the endpoint corresponding to the first maximum intensity color characteristic and the endpoint corresponding to a third one of the maximum intensity color characteristics;

obtaining another first-pass intersection point located in the first volume, at which a line connecting the target point and the endpoint corresponding to the third maximum intensity color characteristic, intersects a boundary line connecting the endpoint corresponding to the first maximum intensity color characteristic and the endpoint corresponding to the second maximum intensity color characteristic;

determining respective amounts of light contributions of the first, second and third maximum intensity color characteristics to system light output for the target point in the first volume, corresponding to the endpoint corresponding to the first maximum intensity color characteristic and the one and the other first-pass intersection points;

determining first, second and third first-pass driver settings respectively for the first, second and third light sources, based on the determined respective amounts of light contributions of the first, second and third maximum intensity color characteristics;

when the light is to be dimmed to a proportion of the maximum target intensity, adjusting the first, second and third first-pass driver settings in accordance with the determined respective amounts of light contributions of the first, second and third maximum intensity color characteristics and with the proportion of the maximum target intensity;

defining, in the first color space, a second volume having boundaries with endpoints corresponding to respective reduced intensity color characteristics of the light sources when operated at the adjusted first, second and third first-pass driver settings;

based on location of the target point in the second volume, identifying a first one of the reduced intensity color characteristics of the light sources when operated at the adjusted first, second and third first-pass driver settings;

obtaining one second-pass intersection point located in the second volume, at which a line connecting the target point and the endpoint corresponding to a second one of the reduced intensity color characteristics, intersects a boundary line connecting the endpoint corresponding to the first reduced intensity color characteristic and the endpoint corresponding to a third of the reduced intensity color characteristics;

obtaining another second-pass intersection point located in the second volume, at which a line connecting the target point and the endpoint corresponding to the third reduced intensity color characteristic, intersects a boundary line connecting the endpoint corresponding to the first reduced intensity color characteristic and the endpoint corresponding to the second reduced intensity color characteristic;

determining respective amounts of light contributions of the first, second and third reduced intensity color characteristics to system light output for the target point in the second volume, corresponding to the endpoint corresponding to the first reduced intensity color characteristic and the one and the other second-pass intersection points;

determining first, second and third second-pass driver settings respectively for the light sources based on the determined respective amounts of light contributions of the first, second and third reduced intensity color characteristics; and applying the determined first, second and third second-pass driver settings, to drive the light sources.

10. The method of claim 9, further comprising a step of correcting for output changes of the light emitters due to temperature changes.

11. The method of claim 10, wherein:

the determining of the first set of both the adjusted first-pass driver settings and the second-pass driver settings for the lighting system uses data on operation of the light emitters at a first temperature, and the correcting step comprises:

determining a second set of both adjusted first-pass driver settings and second-pass driver settings for the lighting system using data on operation of the light emitters at a second temperature; and applying an interpolation to at least the determined second-pass driver settings of the second set according to a third temperature that is different from the first and second temperatures, to obtain an estimated set of second-pass driver settings for the lighting system at the third temperature.

12. The method of claim 9, further comprising a step of correcting for an output change due to a lifetime degradation of the light emitters during a particular period.

13. The method of claim 12, wherein the correcting step comprises increasing the determined light contributions amounts used in the adjusting step by an amount to compensate for the lifetime degradation during the particular period.

14. The method of claim 9, further comprising the steps of:

converting, after obtaining the one and the another first-pass intersection points, the obtained first-pass intersection points and first, second and third ones of the endpoints corresponding to the first, second and third maximum intensity color characteristics, into corresponding points defined in a second color space;

calculating respective first-pass scaling factors of the converted second and third endpoints corresponding to the second and third maximum intensity color characteristics such that each of the converted first-pass intersection points is obtained by adding, to the converted first endpoint corresponding to the first maximum intensity color characteristic, one of the converted second endpoint corresponding to the second maximum intensity color characteristic, multiplied by the respective first-pass scaling factor thereof, and the converted third endpoint corresponding to the third maximum intensity color characteristic, multiplied by the respective first-pass scaling factor thereof;

multiplying the converted first endpoint corresponding to the first maximum intensity color characteristic by the proportion of the maximum target intensity to adjust the first first-pass driver setting; and multiplying each of the converted second and third endpoints corresponding to the second and third maximum intensity color characteristics by the respective first-pass scaling factor thereof and by the proportion of the maximum target intensity, to adjust the second and third first-pass driver settings.

15. The method of claim 14, further comprising the steps of:

converting, after obtaining the one and the another second-pass intersection points, the obtained second-pass intersection points and first, second and third ones of the endpoints corresponding to the first, second and third reduced intensity color characteristics, into corresponding points defined in a second color space;

calculating respective second-pass scaling factors of the converted second and third endpoints corresponding to the second and third reduced intensity color characteristics such that each of the converted second-pass intersection points is obtained by adding, to the converted first endpoint corresponding to the first reduced intensity color characteristic, one of the converted second endpoint corresponding to the second reduced intensity color characteristic, multiplied by the respective second-pass scaling factor thereof, and the converted third endpoint corresponding to the third reduced intensity color characteristic, multiplied by the respective second-pass scaling factor thereof; and multiplying each of the converted second and third endpoints corresponding to the second and third reduced intensity color characteristics by the respective second-pass scaling factor thereof, to determine the second and third second-pass driver settings.

16. The method of claim 9, further comprising the steps of:

converting, after obtaining the one and the another second-pass intersection points, the obtained second-pass intersection points and first, second and third ones of the endpoints corresponding to the first, second and third reduced intensity color characteristics, into corresponding points defined in a second color space;

calculating respective second-pass scaling factors of the converted second and third endpoints corresponding to the second and third reduced intensity color characteristics such that each of the converted second-pass intersection points is obtained by adding, to the converted first endpoint corresponding to the first reduced intensity color characteristic, one of the converted second endpoint corresponding to the second reduced intensity color characteristic, multiplied by the respective second-pass scaling factor thereof, and the converted third endpoint corresponding to the third reduced intensity color characteristic, multiplied by the respective second-pass scaling factor thereof; and multiplying each of the converted second and third endpoints corresponding to the second and third reduced intensity color characteristics by the respective second-pass scaling factor thereof, to adjust the second and third second-pass driver settings.

17. The method of claim 9, wherein one of the three light sources for producing light of a particular one of the three colors includes at least two light sources, each comprising one or more light emitters, and the applying step comprises applying the determined second-pass driver settings to drive the at least two light sources to produce a corrected output light of the particular color.

18. A lighting system, comprising:

three light sources each for producing light of a different one of three colors, each light source comprising one or more light emitters;

an input; and a controller responsive to information received via the input and coupled to control the three light sources to produce a combined light output of the system, wherein the controller is configured to control functions of the lighting system, including functions to:

receive an input relating to color coordinates of a target point defined in a first color space;

in a first volume defined in the first color space, having boundaries with endpoints corresponding to color characteristics of the light sources when operated at or near respective maximum intensities, determine first-pass light amounts of respective maximum intensity light contributions from the light sources to achieve light at the target point;

determine first-pass driver settings for the light sources based on the determined first-pass light amounts;

when the light is to be dimmed to a proportion of the maximum target intensity, adjust the first-pass driver settings in accordance with the determined first-pass light amounts and the proportion of the maximum target intensity;

define, in the first color space, a second volume having boundaries with endpoints corresponding to reduced intensity color characteristics of the light sources when operated at the adjusted first-pass driver settings;

from the second volume, determine second-pass light amounts of respective reduced intensity light contributions from the light sources to achieve light at the target point;

determine second-pass driver settings for the light sources based on the determined second-pass light amounts; and apply the second-pass driver settings to drive the light sources to produce a color corrected output light having a color characteristic corresponding to the target point dimmed to the proportion of the maximum target intensity.

19. The lighting system of claim 18, wherein the light emitters are solid state lighting sources.

20. The lighting system of claim 19, wherein the solid state lighting sources are light emitting diodes (LEDs).

21. The lighting system of claim 18, wherein one of the three light sources for producing light of a particular one of the three colors includes at least two light sources, each comprising one or more light emitters, and responsive to information received via the input, the controller is configured to control the at least two light sources to produce a light output of the particular color.

* * * * *